US008963902B2

(12) United States Patent
Omoto et al.

(10) Patent No.: US 8,963,902 B2
(45) Date of Patent: Feb. 24, 2015

(54) DRIVE CIRCUIT AND DISPLAY DEVICE

(75) Inventors: Keisuke Omoto, Kanagawa (JP); Masatsugu Tomida, Kanagawa (JE)

(73) Assignee: Sony Corporation, Tokyo (JP)

( * ) Notice: Subject to any disclaimer, the term of this patent is extended or adjusted under 35 U.S.C. 154(b) by 1090 days.

(21) Appl. No.: 12/972,719

(22) Filed: Dec. 20, 2010

(65) Prior Publication Data

US 2011/0157117 A1 Jun. 30, 2011

(30) Foreign Application Priority Data

Dec. 25, 2009 (JP) ..... 2009-295552

(51) Int. Cl.
*G09G 3/32* (2006.01)

(52) U.S. Cl.
CPC ..... *G09G 3/3233* (2013.01); *G09G 2320/043* (2013.01); *G09G 2300/043* (2013.01)
USPC ..... 345/208; 345/204; 345/211; 345/214; 345/690; 345/76; 345/82; 345/87

(58) Field of Classification Search
CPC ..... G09G 3/3677; G09G 3/3688; G09G 2310/0286
USPC ..... 345/76–104, 204–215, 690–699
See application file for complete search history.

(56) References Cited

U.S. PATENT DOCUMENTS 6,081,131 A * 6/2000 Ishii ..... 326/68
6,498,596 B1 * 12/2002 Nakamura et al. ..... 345/98
6,822,504 B2 * 11/2004 Morikawa ..... 327/513
7,460,099 B2 * 12/2008 Kubota et al. ..... 345/98
7,605,789 B2 * 10/2009 Uchino et al. ..... 345/92
7,649,398 B2 * 1/2010 Park et al. ..... 327/333
7,652,653 B2 * 1/2010 Nakao et al. ..... 345/100
7,760,167 B2 * 7/2010 Uchino et al. ..... 345/76
7,792,237 B2 * 9/2010 Chen et al. ..... 377/64
7,928,953 B2 * 4/2011 Nishi et al. ..... 345/100
7,956,663 B2 * 6/2011 Jarupoonphol et al. ..... 327/285
8,212,762 B2 * 7/2012 Wang ..... 345/100
8,258,868 B2 * 9/2012 Marshall ..... 330/253
8,653,856 B2 * 2/2014 Piepenstock et al. ..... 326/86
2003/0001832 A1 * 1/2003 Yamazaki et al. ..... 345/204
2003/0222692 A1 * 12/2003 Morikawa ..... 327/261
2005/0212787 A1 * 9/2005 Noguchi et al. ..... 345/204
2007/0018931 A1 * 1/2007 Park et al. ..... 345/98
2007/0057894 A1 * 3/2007 Natori et al. ..... 345/98
2008/0024400 A1 * 1/2008 Uchino et al. ..... 345/77

(Continued)

FOREIGN PATENT DOCUMENTS

JP 2008-083272 A 4/2008

*Primary Examiner* — Allison Johnson
*Assistant Examiner* — Afroza Chowdhury
(74) *Attorney, Agent, or Firm* — Wolf, Greenfield & Sacks, P.C.

(57) ABSTRACT

A drive circuit includes: an input-side inverter circuit and an output-side inverter circuit connected to each other in series and inserted between a high voltage line and a low voltage line. The output-side inverter circuit includes a CMOS transistor having a first gate and a second gate, in which a drain is connected to the high voltage line side and a source is connected to an output side of the output-side inverter circuit. The output-side inverter circuit further includes a MOS transistor in which a drain is connected to the low voltage line side and a source is connected to the output side of the output-side inverter circuit. The output-side inverter circuit further includes a correction circuit correcting a voltage of one or both of the two gates of the CMOS transistor.

18 Claims, 23 Drawing Sheets

(56) References Cited

U.S. PATENT DOCUMENTS

| | | | | |
|---|---|---|---|---|
| 2008/0049053 | A1* | 2/2008 | Asano et al. | 345/697 |
| 2009/0058488 | A1* | 3/2009 | Jarupoonphol et al. | 327/285 |
| 2009/0096737 | A1* | 4/2009 | Kim et al. | 345/98 |
| 2009/0175405 | A1* | 7/2009 | Chen et al. | 377/68 |
| 2010/0149152 | A1* | 6/2010 | Yamamoto et al. | 345/211 |
| 2010/0316182 | A1* | 12/2010 | Lai | 377/79 |
| 2011/0157118 | A1 | 6/2011 | Omoto et al. | |
| 2011/0157119 | A1 | 6/2011 | Omoto | |
| 2011/0234567 | A1* | 9/2011 | Omoto | 345/211 |

* cited by examiner

DRIVE CIRCUIT AND DISPLAY DEVICE

BACKGROUND OF THE INVENTION

1. Field of the Invention

The present invention relates to a drive circuit suitably applicable to a display device that uses, for example, an organic Electro Luminescence (EL) element. The present invention also relates to a display device having the drive circuit.

2. Description of the Related Art

In recent years, in the field of display devices displaying images, a display device that uses, as a light emitting element, an optical element of current-driven type whose light emission intensity changes according to the value of a flowing current, e.g. an organic EL element, has been developed, and its commercialization is proceeding. In contrast to a liquid crystal device and the like, the organic EL element is a self-light-emitting element. Therefore, in the display device using the organic EL element (organic EL display device), gradation of coloring is achieved by controlling the value of a current flowing in the organic EL element.

As a drive system in the organic EL display device, like a liquid crystal display, there are a simple (passive) matrix system and an active matrix system. The former is simple in structure, but has, for example, such a problem that it is difficult to realize a large and high-definition display device. Therefore, currently, development of the active matrix system is brisk. In this system, the current flowing in a light emitting element arranged for each pixel is controlled by a drive transistor.

In the above-mentioned drive transistor, there is a case in which a threshold voltage $V_{th}$ or a mobility μ changes over time, or varies from pixel to pixel due to variations in production process. When the threshold voltage $V_{th}$ or the mobility μ varies from pixel to pixel, the value of the current flowing in the drive transistor varies from pixel to pixel and therefore, even when the same voltage is applied to a gate of the drive transistor, the light emission intensity of the organic EL element varies and uniformity of a screen is impaired. Thus, there has been developed a display device in which a correction function to address a change in the threshold voltage $V_{th}$ or the mobility μ is incorporated (see, for example, Japanese Unexamined Patent Application Publication No. 2008-083272).

A correction to address the change in the threshold voltage $V_{th}$ or the mobility μ is performed by a pixel circuit provided for each pixel. As illustrated in, for example, FIG. 20, this pixel circuit includes: a drive transistor $Tr_1$ controlling a current flowing in an organic EL element 111, a write transistor $Tr_2$ writing a voltage of a signal line DTL into the drive transistor $Tr_1$, and a holding capacitance $C_s$, and therefore, the pixel circuit has a 2Tr1C circuit configuration. The drive transistor $Tr_1$ and the write transistor $Tr_2$ are each formed by, for example, an n-channel MOS Thin Film Transistor (TFT).

FIG. 19 illustrates an example of the waveform of a voltage applied to the pixel circuit and an example of a change in each of a gate voltage and a source voltage of the drive transistor. In Part (A) of FIG. 19, there is illustrated a state in which a signal voltage $V_{sig}$ and an offset voltage $V_{ofs}$ are applied to the signal line DTL. In Part (B) of FIG. 19, there is illustrated a state in which a voltage $V_{dd}$ for turning on the drive transistor and a voltage $V_{ss}$ for turning off the drive transistor are applied to a write line WSL. In Part (C) of FIG. 19, there is illustrated a state in which a high voltage $V_{ccH}$ and a low voltage $V_{ccL}$ are applied to a power-source line PSL. Further, in Part (D) and (E) of FIG. 19, there is illustrated a state in which a gate voltage $V_g$ and a source voltage $V_s$ of the drive transistor $Tr_1$ change over time in response to the application of the voltages to the power-source line PSL, the signal line DTL and the write line WSL.

From FIG. 19, it is found that a WS pulse P1 is applied to the write line WSL twice within 1 H, a threshold correction is performed by the first WS pulse P1, and a mobility correction and signal writing are performed by the second WS pulse P1. In other words, in FIG. 19, the WS pulse P1 is used for not only the signal writing but also the threshold correction and the mobility correction of the drive transistor $Tr_1$.

In the following, the threshold correction and the mobility correction of the drive transistor $Tr_1$ will be described. By the application of the second WS pulse P1, the signal voltage $V_{sig}$ is written into a gate of the drive transistor $Tr_1$. As a result, the drive transistor $Tr_1$ is turned on and a current flows in the drive transistor $Tr_1$. At the time, when a reverse bias is applied to the organic EL element 111, electric charge flowing out from the drive transistor $Tr_1$ fills the holding capacitance $C_s$ and an element capacitance (not illustrated) of the organic EL element 111, causing a rise in the source voltage $V_s$. When the mobility of the drive transistor $Tr_1$ is high, the current flowing in the drive transistor $Tr_1$ is large and thus, the source voltage $V_s$ rises quickly. On the contrary, when the mobility of the drive transistor $Tr_1$ is low, the current flowing in the drive transistor $Tr_1$ is small and thus, the source voltage $V_s$ rises more slowly than when the mobility of the drive transistor $Tr_1$ is high. Therefore, it may be possible to correct the mobility by adjusting a period of time for correcting the mobility.

SUMMARY OF THE INVENTION

Incidentally, in the display device employing the active matrix system, each of a horizontal drive circuit driving a signal line and a write scan circuit selecting each pixel sequentially is configured to basically include a shift resister (not illustrated), and has a buffer circuit for each stage, corresponding to each column or each row of pixels. For example, the buffer circuit in the scan circuit is typically configured such that, as illustrated in FIG. 21, two inverter circuits 210 and 220 are connected to each other in series. In a buffer circuit 200 in FIG. 21, the inverter circuit 210 has such a circuit configuration that a p-channel MOS transistor and an n-channel MOS transistor are connected to each other in parallel. On the other hand, the inverter circuit 220 has such a circuit configuration that a CMOS transistor and an n-channel MOS transistor are connected to each other in parallel. The buffer circuit 200 is inserted between high voltage wiring $L_H$ to which a high-level voltage is applied and low voltage wiring $L_L$ to which a low-level voltage is applied.

However, in the CMOS transistor, as illustrated in, for example, FIG. 22, when a threshold voltage $V_{th1}$ of the p-channel MOS transistor varies by $\Delta V_{th1}$, the timing of a rise in an voltage $V_{out}$ of an output OUT is shifted by $\Delta t_1$. Further, in the CMOS transistor, as illustrated in, for example, FIG. 23, when a threshold voltage $V_{th2}$ of the n-channel MOS transistor varies by $\Delta V_{th2}$, the timing of a rise in the voltage $V_{out}$ of the output OUT is shifted by $\Delta t_2$. Therefore, there is such a problem that when, for example, the timing of a rise in the voltage $V_{out}$ of the output OUT varies and a mobility correction period ΔT varies by $\Delta t_1$ or $\Delta t_2$, a current $I_{ds}$ at the time of light emission varies by $\Delta I_{ds}$ as illustrated in, for example, FIG. 24, and this variation leads to a variation in intensity. Incidentally, FIG. 24 illustrates an example of a relationship between the mobility correction period ΔT and the light emission intensity.

Incidentally, the problem of the variation in the threshold voltage $V_{th}$ not only occurs in the scan circuit of the display device, but also similarly occurs in other device.

In view of the foregoing, it is desirable to provide a drive circuit capable of reducing a variation in the timing of a rise in an output voltage, and a display device including this drive circuit.

According to an embodiment of the present invention, there is provided a drive circuit including an input-side inverter circuit and an output-side inverter circuit connected to each other in series and inserted between a high voltage line and a low voltage line. The output-side inverter circuit includes a CMOS transistor and a MOS transistor. The CMOS transistor has a first gate and a second gate. In the CMOS transistor, a drain is connected to the high voltage line side and a source is connected to an output side of the output-side inverter circuit. In the MOS transistor, a drain is connected to the low voltage line side and a source is connected to the output side of the output-side inverter circuit. This output-side inverter circuit further includes a correction circuit correcting a voltage of one or both of two gates of the CMOS transistor.

According to another embodiment of the present invention, there is provided a display device including: a display section that includes plural scanning lines arranged in rows, plural signal lines arranged in columns and plural pixels arranged in rows and columns; and a drive section that drives each of the pixels. The drive section includes plural drive circuits each provided for each of the scanning lines. Each of the drive circuits in the drive section includes the same elements as those of the above-described drive circuit.

In the above-described drive circuit and display device of the embodiments, the correction circuit correcting the voltage of one or both of the two gates of the CMOS transistor is incorporated in the output-side inverter circuit, of the input-side inverter circuit and the output-side inverter circuit connected to each other in series. Thus, in one or both of the two gates of the CMOS transistor, the voltage corresponding to the threshold voltage of the CMOS transistor can be set as an offset.

According to the above-described drive circuit and the display device of the embodiments, in one or both of the two gates of the CMOS transistor, the voltage corresponding to the threshold voltage of the CMOS transistor can be set as an offset. Thus, a variation can be reduced in timing of a rise in the output voltage of the drive circuit. Therefore, for example, in an organic EL display device, a variation in a current flowing in an organic EL element at the time of light emission can be reduced and thus, uniformity of intensity can be improved.

Other and further objects, features and advantages of the present invention will appear more fully from the following description.

DETAILED DESCRIPTION OF THE PREFERRED EMBODIMENTS

Embodiments of the present invention will be described below in detail with reference to the drawings. Incidentally, the description will be provided in the following order.

1. First embodiment (FIG. 1 through FIG. 4)
2. Second embodiment (FIG. 5 through FIG. 8)
3. Third embodiment (FIG. 9 through FIG. 12)
4. Fourth embodiment (FIG. 13 through FIG. 16)
5. Application example (FIG. 17 through FIG. 19)
6. Description of related art (FIG. 20 through FIG. 24)

<First Embodiment>

[Structure]

Figure 1:
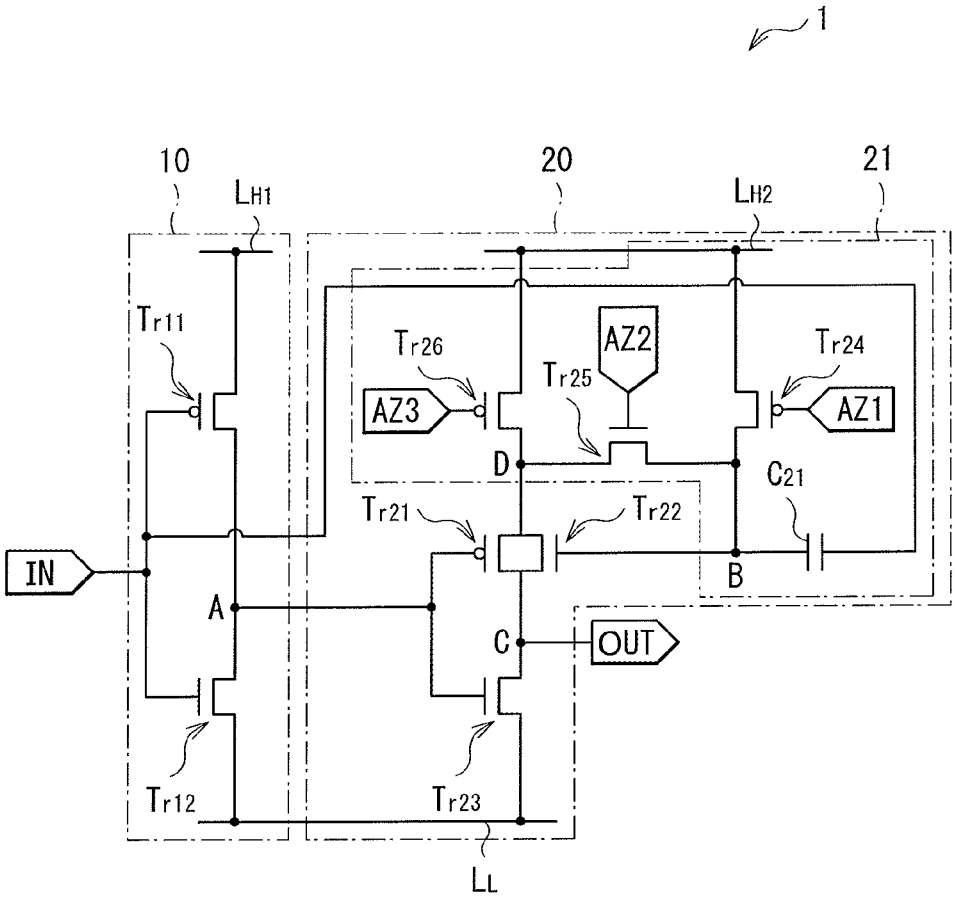
FIG. 1 is a circuit diagram illustrating an example of a buffer circuit according to a first embodiment of the present invention.

FIG. 1 illustrates an example of the entire structure of a buffer circuit 1 (drive circuit) according to the first embodiment of the present invention. The buffer circuit 1 outputs, from an output end OUT, a pulse signal approximately in phase with a pulse signal input into an input end IN. The buffer circuit 1 includes an inverter circuit 10 (input-side inverter circuit) and an inverter circuit 20 (output-side inverter circuit).

The inverter circuits 10 and 20 output a pulse signal whose waveform is approximately the inverse of the signal waveform of the input pulse signal. The inverter circuits 10 and 20 are connected to each other in series. The inverter circuit 10 is arranged on the input end IN side in the relationship with the inverter circuit 20, and an input end of the inverter circuit 10 corresponds to the input end IN of the buffer circuit 1. On the other hand, the inverter circuit 20 is arranged on the output end OUT side in the relationship with the inverter circuit 10, and an output end of the inverter circuit 20 corresponds to the output end OUT of the buffer circuit 1. An output end (a point corresponding to A in the figure) of the inverter circuit 10 is connected to an input end of the inverter circuit 20, and the buffer circuit 1 is configured such that an output of the inverter circuit 10 is input into the inverter circuit 20.

The inverter circuit 10 is inserted between a high voltage line $L_{H1}$ and a low voltage line $L_L$, and the inverter circuit 20 is inserted between a high voltage line $L_{H2}$ and the low voltage line $L_L$. Here, the high voltage line $L_{H1}$ and the high voltage line $L_{H2}$ are independent of each other, and voltages different from each other can be applied to the high voltage line $L_{H1}$ and the high voltage line $L_{H2}$.

The inverter circuit 10 includes a first electro-conductive type transistor $Tr_{11}$ and a second electro-conductive type transistor $Tr_{12}$. The first electro-conductive type transistor $Tr_{11}$ is, for example, a p-channel Metal Oxide Semiconductor (MOS) transistor, and the second electro-conductive type transistor $Tr_{12}$ is, for example, an n-channel MOS transistor.

The transistors $Tr_{11}$ and $Tr_{12}$ are connected to each other in parallel. Specifically, the respective gates of the transistors $Tr_{11}$ and $Tr_{12}$ are connected to each other. Further, a source or a drain of the transistor $Tr_{11}$ and a source or a drain of the transistor $Tr_{12}$ are connected to each other. Furthermore, the respective gates of the transistors $Tr_{11}$ and $Tr_{12}$ are connected to the input end of the inverter circuit 10 (the input end IN of the buffer circuit 1). A connection point A between the source or the drain of the transistor $Tr_{11}$ and the source or the drain of the transistor $Tr_{12}$ is connected to the output end of the inverter circuit 10. Of the source and the drain of the transistor $Tr_{11}$, one that is not connected to the transistor $Tr_{12}$ is connected to the high voltage line $L_{H1}$. On the other hand, of the source and the drain of the transistor $Tr_{12}$, one that is not connected to the transistor $Tr_{11}$ is connected to the low voltage line $L_L$. Incidentally, in the inverter circuit 10, an element of some kind may be provided between the transistor $Tr_{11}$ and the transistor $Tr_{12}$, between the transistor $Tr_{11}$ and the high voltage line $L_{H1}$, or between the transistor $Tr_{12}$ and the low voltage line $L_L$.

The inverter circuit 20 includes a first electro-conductive type transistor $Tr_{21}$, a second electro-conductive type transistor $Tr_{22}$, and a first electro-conductive type transistor $Tr_{23}$. Each of the transistors $Tr_{21}$ and $Tr_{23}$ is, for example, a p-channel MOS transistor, and the transistor $Tr_{22}$ is, for example, an n-channel MOS transistor.

The transistors $Tr_{21}$ and $Tr_{22}$ implement a CMOS transistor. Between the transistors $Tr_{21}$ and $Tr_{22}$, the respective drains are connected to each other and also the respective sources are connected to each other. Further, in the transistors $Tr_{21}$ and $Tr_{22}$, the drains are connected to the high voltage line $L_{H2}$ side and the sources are connected to the output end of the inverter circuit 20 (the output end OUT of the buffer circuit 1). The respective drains of the transistors $Tr_{21}$ and $Tr_{22}$ are connected to, specifically, the high voltage line $L_{H2}$ via a transistor $Tr_{26}$ of a threshold correction circuit 21 to be described later. On the other hand, the respective sources of the transistors $Tr_{21}$ and $Tr_{22}$ are connected to, specifically, the low voltage line $L_L$ via the transistor $Tr_{23}$.

Like the transistors $Tr_{11}$ and $Tr_{12}$, the transistors $Tr_{21}$ and $Tr_{23}$ are connected to each other in parallel. The respective gates of the transistors $Tr_{21}$ and $Tr_{23}$ are connected to each other. Further, a source or a drain of the transistor $Tr_{21}$ and a source or a drain of the transistor $Tr_{23}$ are connected to each other. The respective gates of the transistors $Tr_{21}$ and $Tr_{23}$ are connected to the output end of the inverter circuit 10 (the connection point A). A connection point C between the source or the drain of the transistor $Tr_{21}$ and the source or the drain of the transistor $Tr_{23}$ is connected to the output end of the inverter circuit 20 (the output end OUT of the buffer circuit 1). Of the source and the drain of the transistor $Tr_{23}$, one that is not connected to the transistor $Tr_{21}$ is connected to the low voltage line $L_L$. Incidentally, in the inverter circuit 20, an element of some kind may be provided between the transistor $Tr_{21}$ and the transistor $Tr_{23}$, between the transistor $Tr_{21}$ and the high voltage line $L_{H2}$, or between the transistor $Tr_{23}$ and the low voltage line $L_L$.

The inverter circuit 20 further includes the threshold correction circuit 21 (correction circuit) that corrects a gate voltage $V_g$ (not illustrated) of the transistor $Tr_{22}$. Specifically, the threshold correction circuit 21 is configured to set, in a gate of the transistor $Tr_{22}$, a threshold voltage $V_{th1}$ (not illustrated) of the transistor $Tr_{22}$ or a voltage corresponding to the threshold voltage $V_{th1}$ of the transistor $Tr_{22}$, as an offset.

The threshold correction circuit 21 includes a first electro-conductive type transistor $Tr_{24}$ (first transistor), a second electro-conductive type transistor $Tr_{25}$ (second transistor), a first electro-conductive type transistor $Tr_{26}$ (third transistor), and a capacitor $C_{21}$ (first capacitor). Each of the transistors $Tr_{24}$ and $Tr_{26}$ is, for example, a p-channel MOS transistor, and the transistor $Tr_{25}$ is, for example, an n-channel MOS transistor.

A source or a drain of the transistor $Tr_{24}$ is connected to a source or a drain of the transistor $Tr_{25}$ and the capacitor $C_{21}$. A connection point B, in which the source or the drain of the transistor $Tr_{24}$, the source or the drain of the transistor $Tr_{25}$ and the capacitor $C_{21}$ are interconnected, is connected to the gate of the transistor $Tr_{22}$. The capacitor $C_{21}$ is inserted between the gate of the transistor $Tr_{22}$ (or the connection point B) and the input end of the inverter circuit 10. Of the source and the drain of the transistor $Tr_{25}$, one that is not connected to the connection point B is connected to the source or the drain of the transistor $Tr_{26}$. Of the source and the drain of the transistor $Tr_{26}$, one that is not connected to the source or the drain of the transistor $Tr_{25}$ is connected to the high voltage line $L_{H2}$. A connection point D between the source or the drain of the transistor $Tr_{25}$ and the source or the drain of the transistor $Tr_{26}$ is connected the drains of the transistors $Tr_{21}$ and $Tr_{22}$. Incidentally, in threshold correction circuit 21, an element of some kind may be provided between the transistor $Tr_{24}$ and the transistor $Tr_{25}$, between the transistor $Tr_{25}$ and the transistor $Tr_{26}$, between the transistor $Tr_{24}$ and the capacitor $C_{21}$, between the transistor $Tr_{24}$ and the high voltage line $L_{H2}$, or between the transistor $Tr_{26}$ and the high voltage line $L_{H2}$.

The respective gates of the three transistors (the transistors $Tr_{24}$ through $Tr_{26}$) in the threshold correction circuit 21 are respectively connected to control signal lines not illustrated, and to these gates of the transistors $Tr_{24}$ through $Tr_{26}$, control signals AZ1 through AZ3 are input via those control signal lines, respectively.

[Operation]

Next, operation of the buffer circuit 1 in the present embodiment will be described. In the following, a threshold correction ($V_{th}$ cancel) in the buffer circuit 1 will be mainly described.

Figure 2:
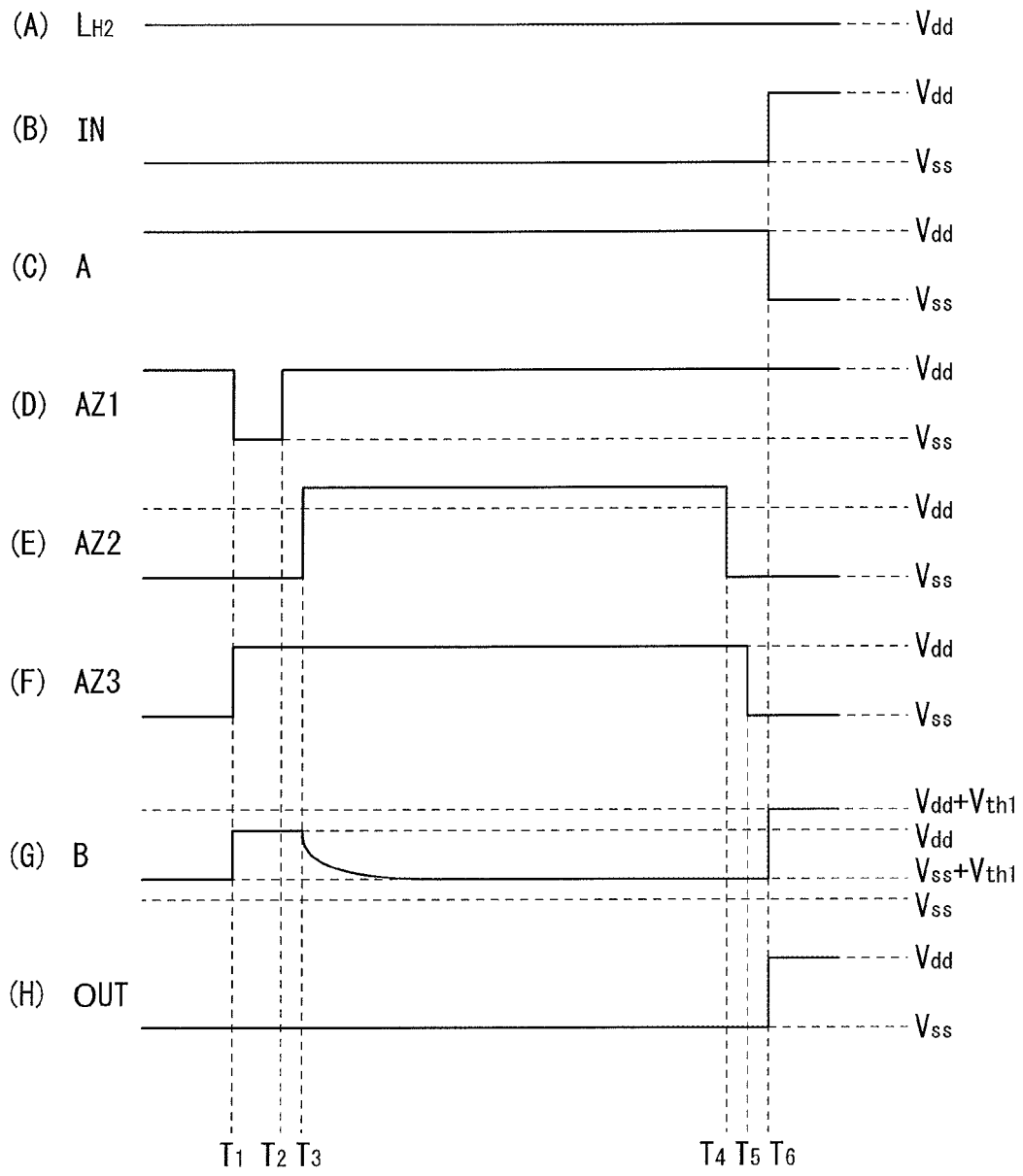
FIG. 2 is a waveform diagram illustrating an example of operation of the buffer circuit in FIG. 1.

FIG. 2 illustrates an example of the operation of the buffer circuit 1. FIG. 2 illustrates an example of operation of cancelling the threshold voltage $V_{th1}$ included in a gate-source voltage $V_{gs}$ of the transistor $Tr_{22}$. Incidentally, the voltage of the high voltage line $L_{H2}$ is assumed to remain, as illustrated in part (A) of FIG. 2, at a constant value ($V_{dd}$) during this operation.

Initially, $V_{ss}$ is input into the input end IN of the buffer circuit 1, and the voltage of the connection point A (the output end of the inverter circuit 10) is $V_{dd}$. Therefore, the transistor $Tr_{21}$ is off, and the transistor $Tr_{22}$ is on. At the time, the control signal AZ1 is $V_{dd}$, and the control signals AZ2 and AZ3 are both $V_{ss}$. Therefore, the transistors $Tr_{24}$ and $Tr_{25}$ are off, and the transistor $Tr_{26}$ is on. Next, the control signal AZ1 becomes $V_{ss}$, the control signal AZ3 becomes $V_{dd}$ ($T_1$), the transistor $Tr_{24}$ turns on, and the transistor $Tr_{26}$ turns off. Then, the voltage of the connection point B becomes $V_{dd}$. Subsequently, the control signal AZ1 becomes $V_{dd}$ ($T_2$), the transistor $Tr_{24}$ turns off, and then, the control signal AZ2 becomes a value slightly larger than $V_{dd}$ ($T_3$), and the transistor $Tr_{25}$ turns on. Then, a current flows in the transistors $Tr_{25}$ and $Tr_{22}$, the voltage of the connection point B gradually falls, and eventually reaches $V_{ss}+V_{th1}$ and at this moment, the transistor $Tr_{22}$ turns off. As a result, the voltage of the connection point B stops falling at $V_{ss}+V_{th1}$, and is maintained at $V_{ss}+V_{th1}$. In other words, by performing the above-described series of operations, the threshold voltage $V_{th1}$ of the transistor $Tr_{22}$ or a voltage corresponding to the threshold voltage $V_{th1}$ of the transistor $Tr_{22}$ is set in the gate of the transistor $Tr_{22}$, as an offset. As a result, even when there is a variation in the threshold voltage $V_{th1}$ of the transistor $Tr_{22}$, an output pulse of $V_{dd}$ is output from the output end OUT of the buffer circuit 1 accurately without a variation in width, according to the input pulse of $V_{dd}$ input into the input end IN of the buffer circuit 1. Therefore, in the timing of a rise from $V_{ss}$ to $V_{dd}$ in the output voltage of the buffer circuit 1, the variation can be reduced.

In this way, in the buffer circuit 1 of the present embodiment, the threshold voltage $V_{th1}$ of the transistor $Tr_{22}$ or a voltage corresponding to the threshold voltage $V_{th1}$ of the transistor $Tr_{22}$ is set in the gate of the transistor $Tr_{22}$ as an offset. As a result, a variation can be reduced in the timing of a rise in the output voltage of the buffer circuit 1.

Incidentally, when the buffer circuit 1 of the present embodiment is applied to, for example, an output stage of a scanner of an organic EL display device, a mobility correction period can be defined by the pulse width of the output voltage of the buffer circuit 1. This makes it possible to reduce a variation in the mobility correction period and therefore, a variation in the current flowing in the organic EL element at the time of light emission can be reduced and uniformity of intensity can be improved.

<Modification of First Embodiment>

Figure 3:
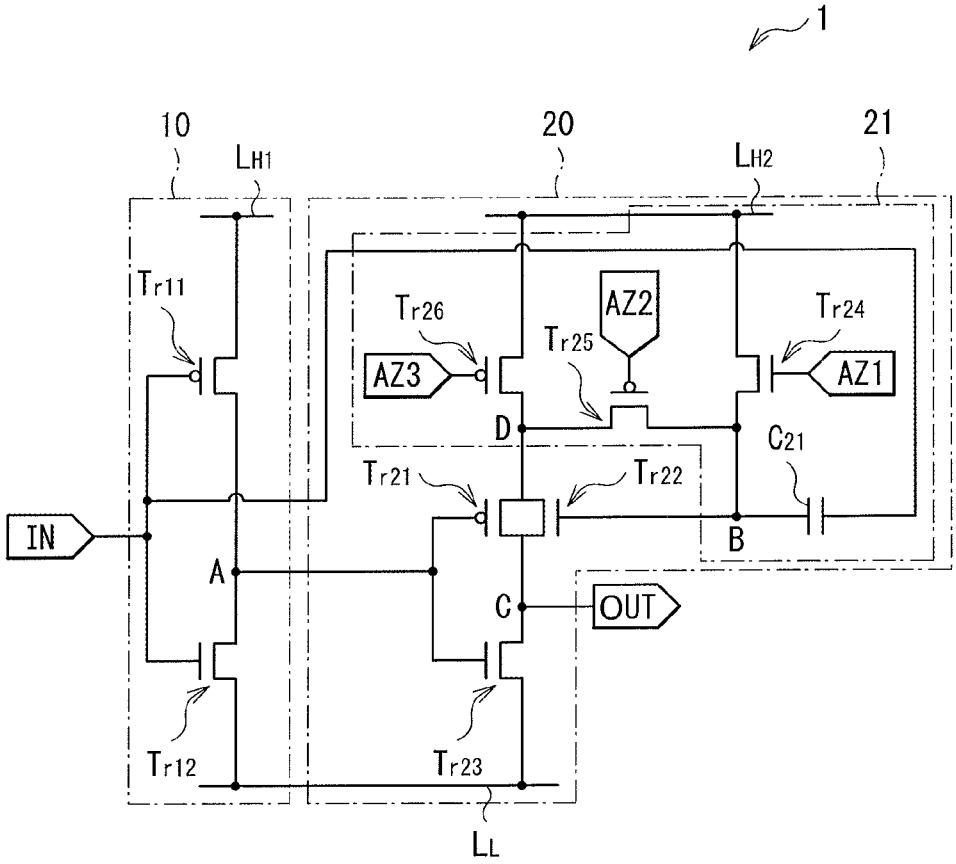
FIG. 3 is a circuit diagram illustrating another example of the buffer circuit in FIG. 1.
Figure 4:
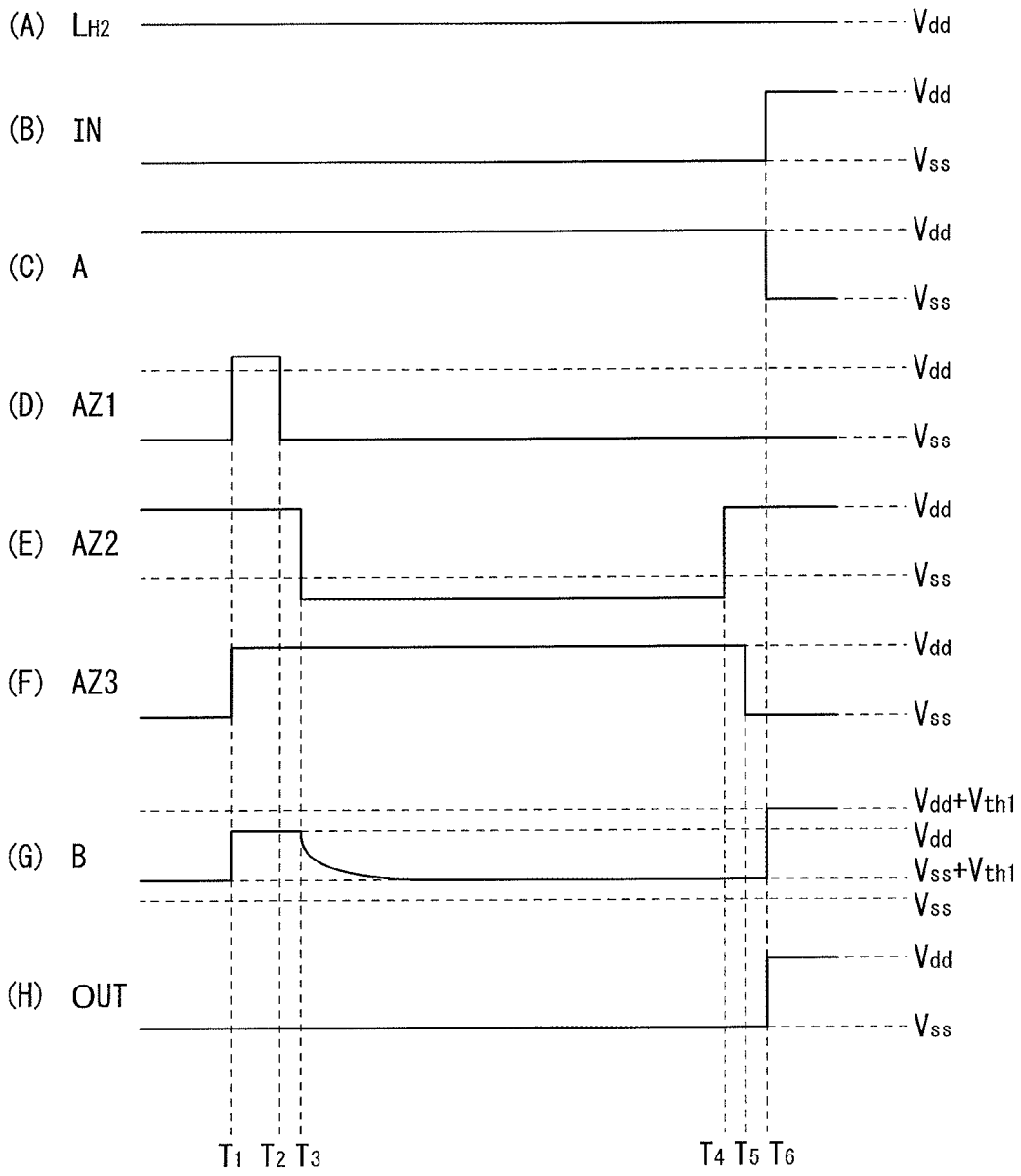
FIG. 4 is a waveform diagram illustrating an example of operation of the buffer circuit in FIG. 3.

In the above-described embodiment, the transistor $Tr_{24}$ is a p-channel MOS transistor, and the transistor $Tr_{25}$ is an n-channel MOS transistor. However, the electro-conductive types of these transistors $Tr_{24}$ and $Tr_{25}$ may be all reversed. Specifically, as illustrated in FIG. 3, the transistor $Tr_{24}$ may be an n-channel MOS transistor, and the transistor $Tr_{25}$ may be a p-channel MOS transistor. In this case however, as illustrated in FIG. 4, the signal waveforms of the control signals AZ1 and AZ2 are desired to be the inverse of the signal waveforms of the control signals AZ1 and AZ2 illustrated in FIG. 2.

<Second Embodiment>

Figure 5:
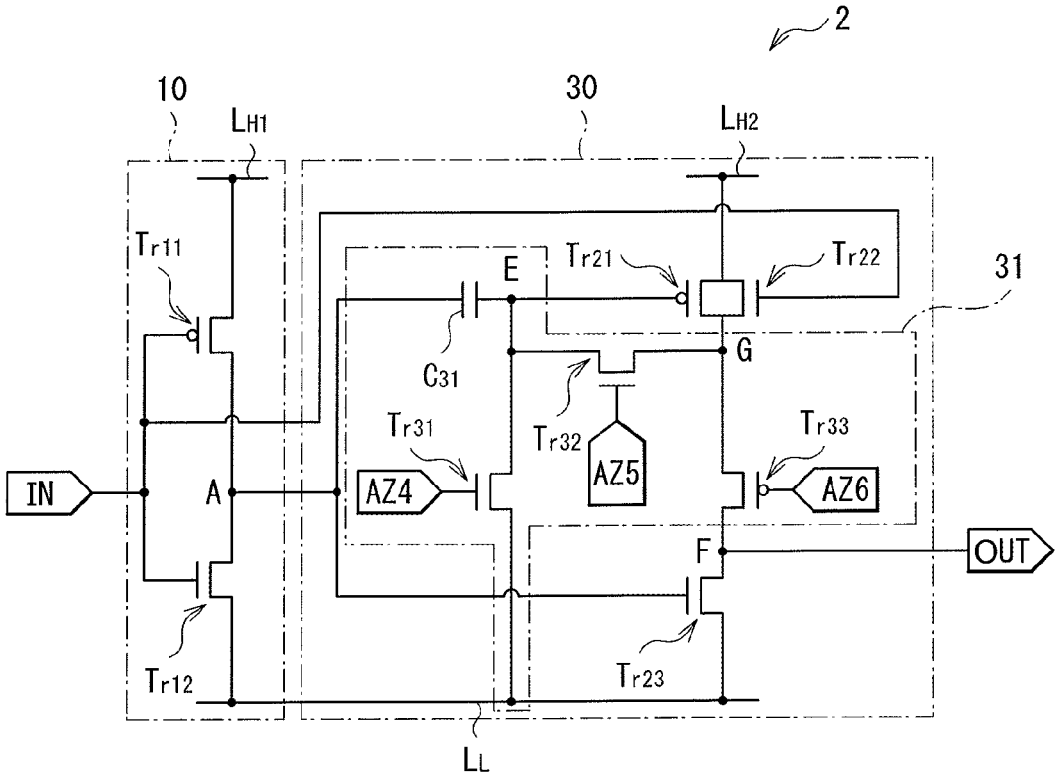
FIG. 5 is a circuit diagram illustrating an example of a buffer circuit according to a second embodiment of the present invention.

Next, a buffer circuit 2 (drive circuit) according to the second embodiment will be described. FIG. 5 illustrates an example of the entire structure of the buffer circuit 2. Like the buffer circuit 1 described above, the buffer circuit 2 outputs, from an output end OUT, a pulse signal approximately in phase with a pulse signal input into an input end IN. The buffer circuit 2 includes the inverter circuit 10 (input-side inverter circuit) and an inverter circuit 30 (output-side inverter circuit).

The inverter circuit 30 outputs a pulse signal whose signal waveform is approximately the inverse of the signal waveform of the input pulse signal. The inverter circuits 10 and 30 are connected to each other in series. The inverter circuit 10 is arranged on the input end IN side in the relationship with the inverter circuit 30, and the input end of the inverter circuit 10 corresponds to the input end IN of the buffer circuit 2. On the other hand, the inverter circuit 30 is arranged on the output end OUT side in the relationship with the inverter circuit 10, and an output end of the inverter circuit 30 corresponds to the output end OUT of the buffer circuit 2. The output end (a point corresponding to A in the figure) of the inverter circuit 10 is connected to an input end of the inverter circuit 30, and the buffer circuit 2 is configured such that an output of the inverter circuit 10 is input into the inverter circuit 30. The inverter circuit 30 is inserted between the high voltage line $L_{H2}$ and the low voltage line $L_L$.

The inverter circuit 30 has a circuit configuration similar to that of the inverter circuit 20 of the embodiment descried earlier, except that a threshold correction circuit 31 is provided in place of the threshold correction circuit 21. The threshold correction circuit 31 corrects a gate voltage $V_g$ (not illustrated) of a transistor $Tr_{21}$. Specifically, the threshold correction circuit 31 is configured to set, in a gate of a transistor $Tr_{21}$, a threshold voltage $V_{th2}$ (not illustrated) of the transistor $Tr_{21}$ or a voltage corresponding to the threshold voltage $V_{th2}$ of the transistor $Tr_{21}$, as an offset.

The threshold correction circuit 31 includes a second electro-conductive type transistor $Tr_{31}$ (fourth transistor), a second electro-conductive type transistor $Tr_{32}$ (fifth transistor), a first electro-conductive type transistor $Tr_{33}$ (sixth transistor), and a capacitor $C_{31}$ (second capacitor). Each of the transistors $Tr_{31}$ and $Tr_{32}$ is, for example, an n-channel MOS transistor, and the transistor $Tr_{33}$ is, for example, a p-channel MOS transistor.

A source or a drain of the transistor $Tr_{31}$ is connected to a source or a drain of the transistor $Tr_{32}$ and the capacitor $C_{31}$. A connection point E, in which the source or the drain of the transistor $Tr_{31}$, the source or the drain of the transistor $Tr_{32}$ and the capacitor $C_{31}$ are interconnected, is connected to the gate of the transistor $Tr_{21}$. The capacitor $C_{31}$ is inserted between the gate of the transistor $Tr_{21}$ (or the connection point E) and the input end of the inverter circuit 10. Of the source and the drain of the transistor $Tr_{32}$, one that is not connected to the connection point E is connected to a source or the drain of the transistor $Tr_{33}$. Of the source and the drain of the transistor $Tr_{33}$, one that is not connected to the source or the drain of the transistor $Tr_{32}$ is connected to, of the source and the drain of the transistor $Tr_{23}$, one that is not connected to the low voltage line $L_L$. A connection point F between the source or the drain of the transistor $Tr_{33}$ and the source or the drain of the transistor $Tr_{23}$ is connected to the output end of the inverter circuit 30 (the output end OUT of the buffer circuit 2). A connection point G between the source or the drain of the transistor $Tr_{32}$ and the source or the drain of the transistor $Tr_{33}$ is connected the sources of the transistors $Tr_{21}$ and $Tr_{22}$. Incidentally, in threshold correction circuit 31, an element of some kind may be provided between the transistor $Tr_{31}$ and the transistor $Tr_{32}$, between the transistor $Tr_{32}$ and the transistor $Tr_{33}$, between the transistor $Tr_{32}$ and the capacitor $C_{31}$, between the transistor $Tr_{31}$ and the low voltage line $L_L$, or between the transistor $Tr_{33}$ and the low voltage line $L_L$.

The respective gates of the three transistors (the transistors $Tr_{31}$ through $Tr_{33}$) in the threshold correction circuit 31 are respectively connected to control signal lines not illustrated, and to these gates of the transistors $Tr_{31}$ through $Tr_{33}$, control signals AZ4 through AZ6 are input via those control signal lines, respectively.

[Operation]

Next, operation of the buffer circuit 2 in the present embodiment will be described. In the following, a threshold correction ($V_{th}$ cancel) in the buffer circuit 2 will be mainly described.

Figure 6:
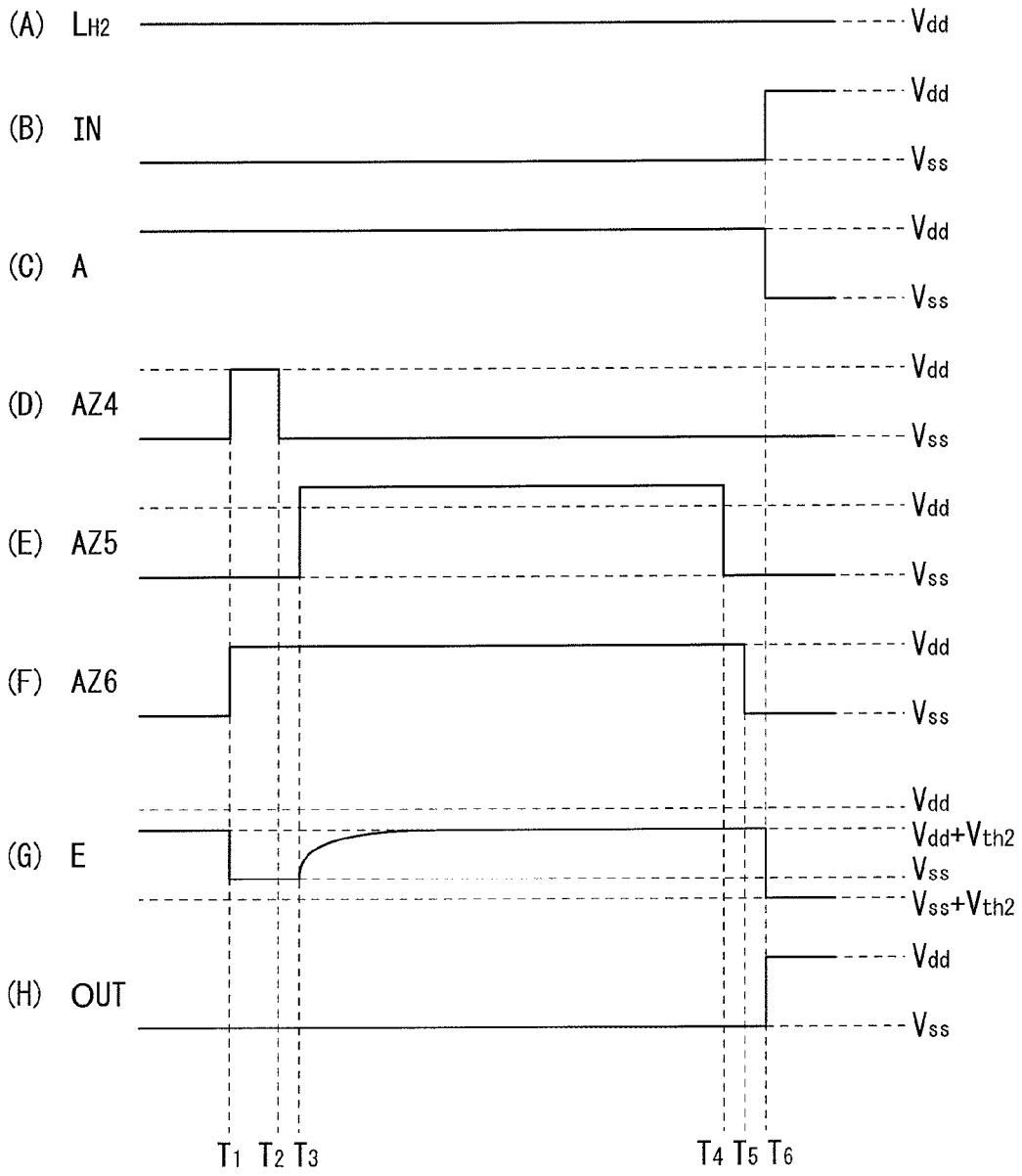
FIG. 6 is a waveform diagram illustrating an example of operation of the buffer circuit in FIG. 5.

FIG. 6 illustrates an example of the operation of the buffer circuit 2. FIG. 6 illustrates an example of operation of cancelling the threshold voltage $V_{th2}$ included in the gate-source voltage $V_g$, of the transistor $Tr_{21}$. Incidentally, the voltage of the high voltage line $L_{H2}$ is assumed to remain, as illustrated in part (A) of FIG. 6, at a constant value ($V_{dd}$) during this operation.

Initially, $V_{ss}$ is input into the input end IN of the buffer circuit 2, and the voltage of the connection point A (the output end of the inverter circuit 10) is $V_{dd}$. Therefore, the transistor $Tr_{21}$ is off, and the transistor $Tr_{22}$ is on. At the time, the control signals AZ4 through AZ6 are all $V_{ss}$, the transistors $Tr_{31}$ and $Tr_{32}$ are off, and the transistor $Tr_{33}$ is on. Next, the control signal AZ4 becomes $V_{dd}$, the control signal AZ6 becomes $V_{dd}$ ($T_1$), the transistor $Tr_{31}$ turns on, and the transistor $Tr_{33}$ turns off. Then, the voltage of the connection point E becomes $V_{ss}$. Subsequently, the control signal AZ4 becomes $V_{ss}$ ($T_2$), the transistor $Tr_{31}$ turns off, and then, the control signal AZ5 becomes a value slightly larger than $V_{dd}$ ($T_3$), and the transistor $Tr_{32}$ turns on. Then, a current flows in the transistors $Tr_{32}$ and $Tr_{22}$, the voltage of the connection point E gradually rises, and eventually reaches $V_{dd}+V_{th2}$ and at this moment, the transistor $Tr_{22}$ turns off. As a result, the voltage of the connection point E stops falling at $V_{dd}+V_{th2}$, and is maintained at $V_{dd}+V_{th2}$. In other words, by performing the above-described series of operations, the threshold voltage $V_{th2}$ of the transistor $Tr_{21}$ or a voltage corresponding to the threshold voltage $V_{th2}$ of the transistor $Tr_{21}$ is set in the gate of the transistor $Tr_{21}$ as an offset. As a result, even when there is a variation in the threshold voltage $V_{th2}$ of the transistor $Tr_{21}$, an output pulse of $V_{dd}$ is output from the output end OUT of the buffer circuit 2 accurately without a variation in width, according to the input pulse of $V_{dd}$ input into the input end IN of the buffer circuit 2. Therefore, in the timing of a rise from $V_{ss}$ to $V_{dd}$ in the output voltage of the buffer circuit 2, the variation can be reduced.

In this way, in the buffer circuit 2 of the present embodiment, the threshold voltage $V_{th2}$ of the transistor $Tr_{21}$ or a voltage corresponding to the threshold voltage $V_{th2}$ of the transistor $Tr_{21}$ is set in the gate of the transistor $Tr_{21}$ as an offset. As a result, a variation can be reduced in the timing of a rise in the output voltage of the buffer circuit 2.

Incidentally, when the buffer circuit 2 of the present embodiment is applied to, for example, an output stage of a scanner of an organic EL display device, a mobility correction period can be defined by the pulse width of the output voltage of the buffer circuit 2. This makes it possible to reduce a variation in the mobility correction period and therefore, a variation in the current flowing in the organic EL element at the time of light emission can be reduced and uniformity of intensity can be improved.

<Modification of Second Embodiment>

Figure 7:
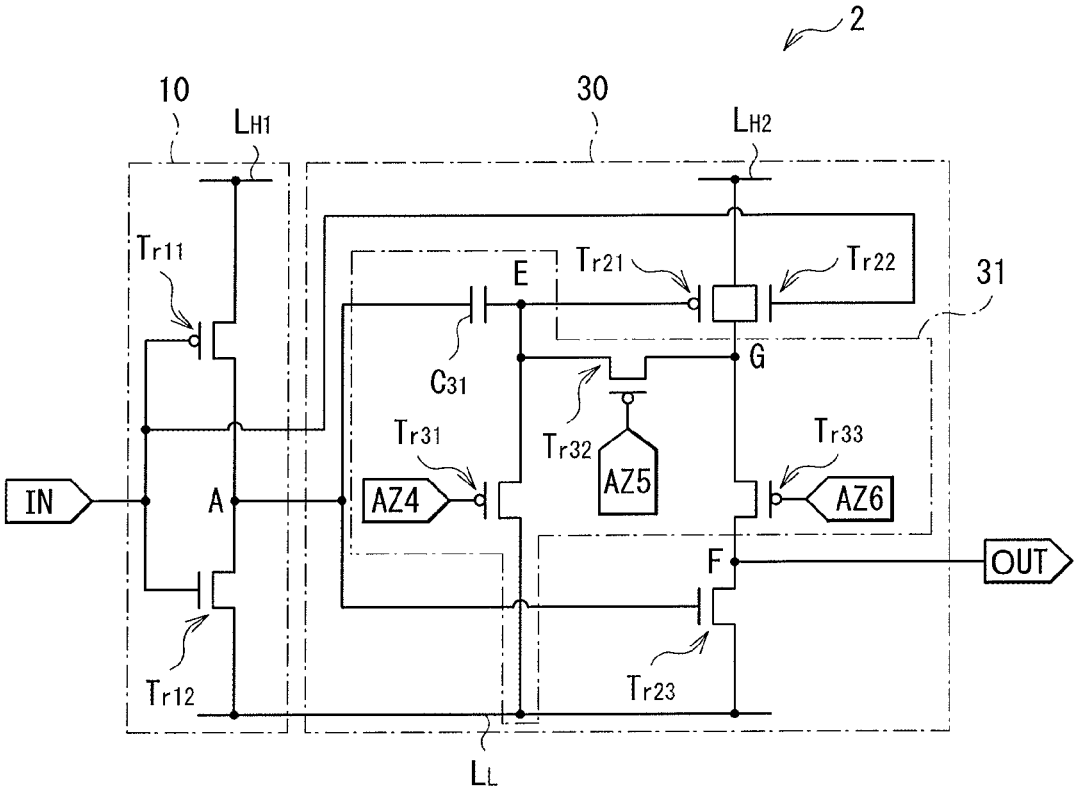
FIG. 7 is a circuit diagram illustrating another example of the buffer circuit in FIG. 5.
Figure 8:
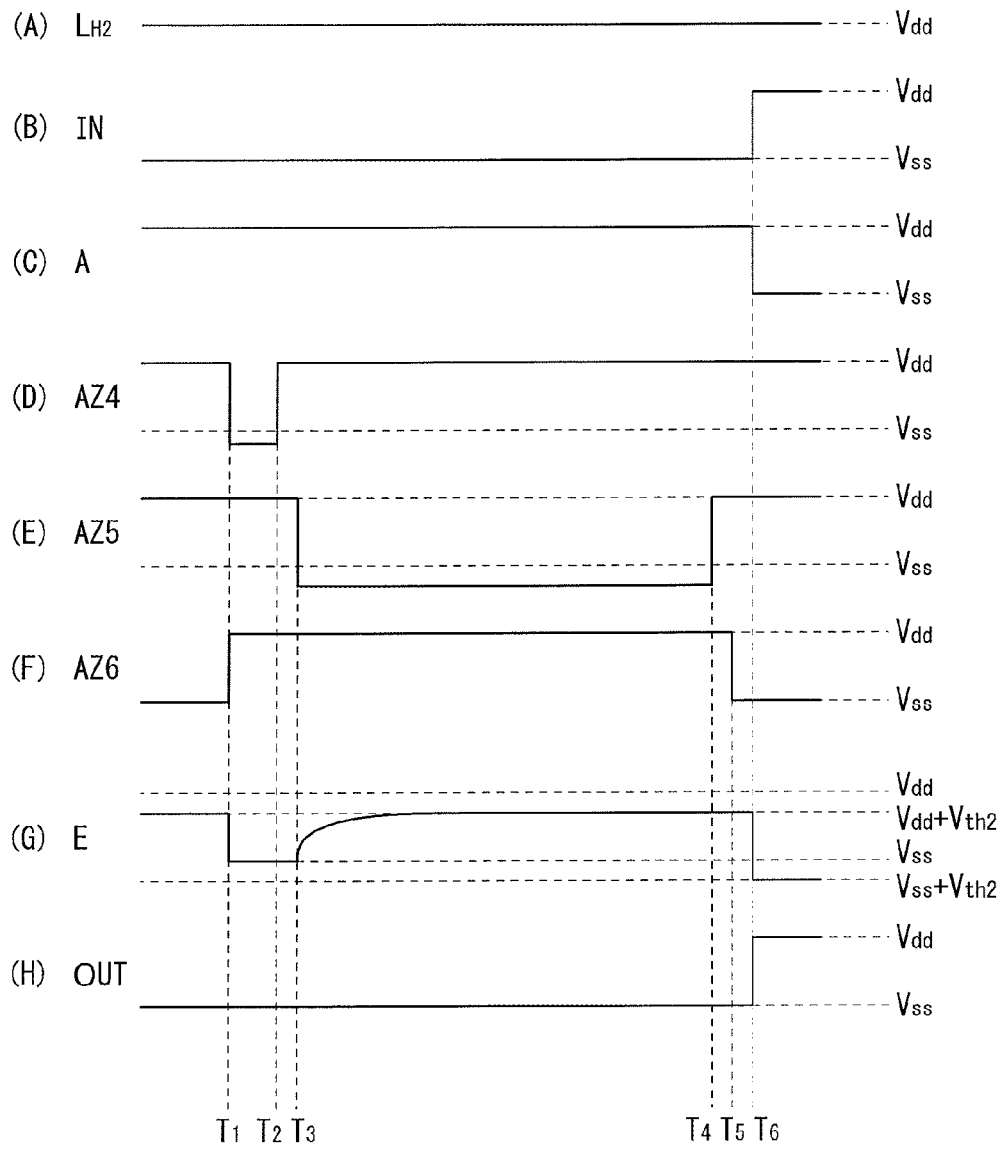
FIG. 8 is a circuit diagram illustrating an example of operation of the buffer circuit in FIG. 7.

In the second embodiment, each of the transistors $Tr_{31}$ and $Tr_{32}$ is an n-channel MOS transistor, but the electro-conductive types of these transistors $Tr_{31}$ and $Tr_{32}$ may be all reversed. Specifically, as illustrated in FIG. 7, each of the transistors $Tr_{31}$ and $Tr_{32}$ may be a p-channel MOS transistor. In this case however, as illustrated in, for example, FIG. 8, the signal waveforms of the control signals AZ4 and AZ5 are desired to be the inverse of the signal waveforms of the control signals AZ4 and AZ5 illustrated in FIG. 6.

<Third Embodiment>

Figure 9:
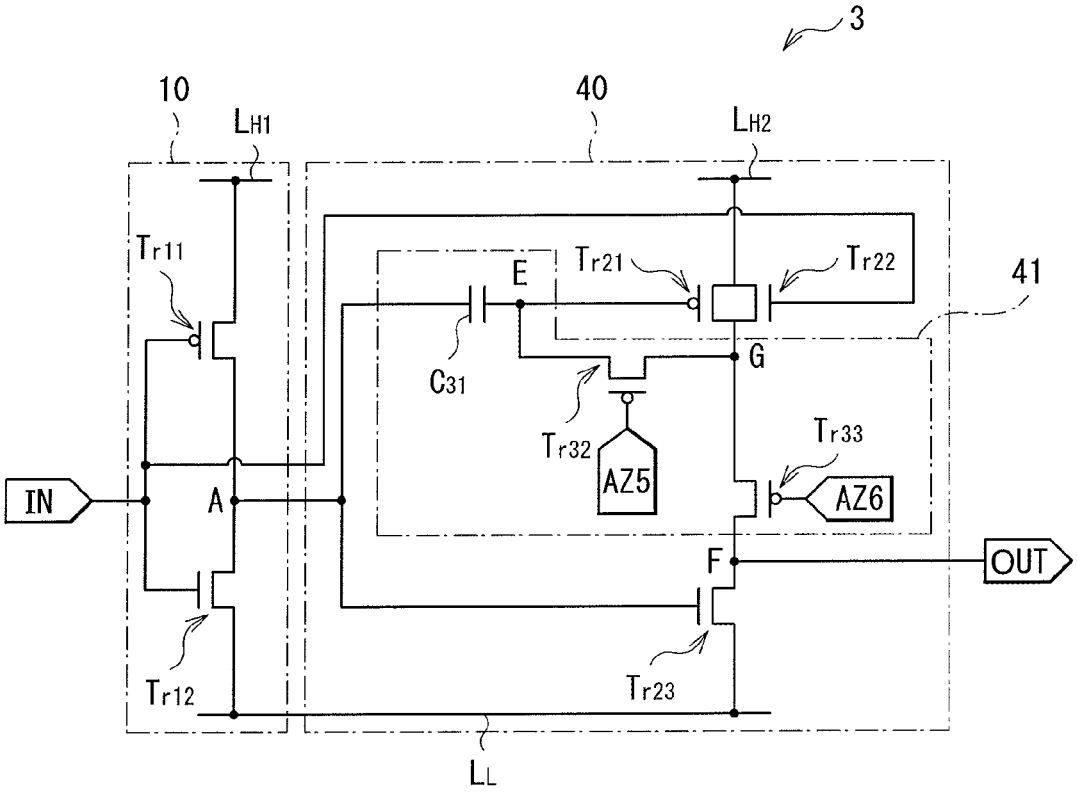
FIG. 9 is a circuit diagram illustrating an example of a buffer circuit according to a third embodiment of the present invention.

Next, a buffer circuit 3 (drive circuit) according to the third embodiment will be described. FIG. 9 illustrates an example of the entire structure of the buffer circuit 3. Like the buffer circuit 2, the buffer circuit 3 outputs, from an output end OUT, a pulse signal approximately in phase with a pulse signal input into an input end IN. The buffer circuit 3 includes the inverter circuit 10 (input-side inverter circuit) and an inverter circuit 40 (output-side inverter circuit).

The inverter circuit 40 outputs a pulse signal whose signal waveform is approximately the inverse of the signal waveform of the input pulse signal. The inverter circuits 10 and 40 are connected to each other in series. The inverter circuit 10 is arranged on the input end IN side in the relationship with the inverter circuit 40, and the input end of the inverter circuit 10 corresponds to the input end IN of the buffer circuit 3. On the other hand, the inverter circuit 40 is arranged on the output end OUT side in the relationship with the inverter circuit 10, and an output end of the inverter circuit 40 corresponds to the output end OUT of the buffer circuit 3. The output end (a point corresponding to A in the figure) of the inverter circuit 10 is connected to an input end of the inverter circuit 40, and the buffer circuit 3 is configured such that an output of the inverter circuit 10 is input into the inverter circuit 40. The inverter circuit 40 is inserted between the high voltage line $L_{H2}$ and the low voltage line $L_L$.

The inverter circuit 40 has a circuit configuration similar to that of the inverter circuit 30 of the second embodiment, except that a threshold correction circuit 41 is provided in place of the threshold correction circuit 31. Here, the threshold correction circuit 41 has a circuit configuration similar to that of the threshold correction circuit 31 from which the transistor $Tr_{31}$ is eliminated. Further, in the threshold correction circuit 41, the transistor $Tr_{32}$ is a second electro-conductive type transistor, e.g. a p-channel MOS transistor.

[Operation]

Next, operation of the buffer circuit 3 in the present embodiment will be described. In the following, a threshold correction ($V_{th}$ cancel) in the buffer circuit 3 will be mainly described.

Figure 10:
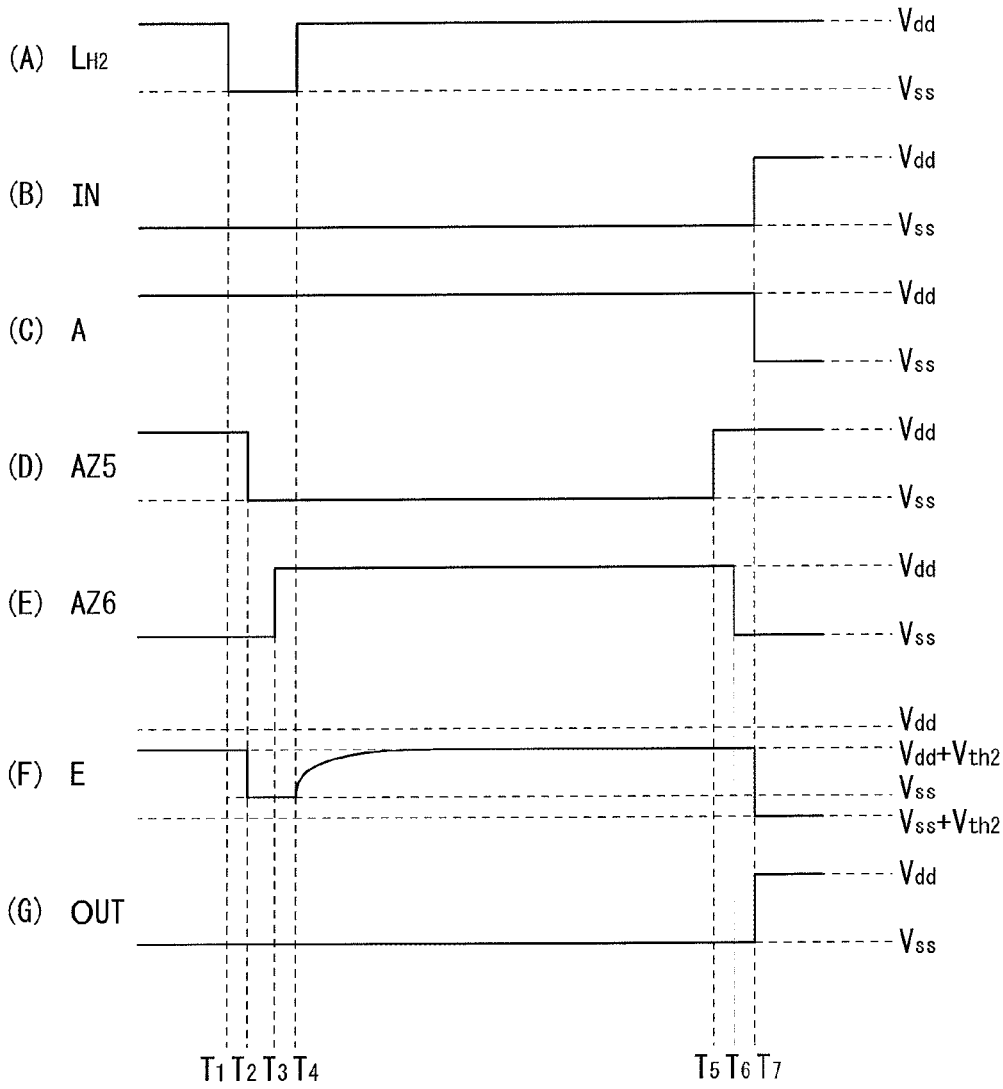
FIG. 10 is a waveform diagram illustrating an example of operation of the buffer circuit in FIG. 9.

FIG. 10 illustrates an example of the operation of the buffer circuit 3. FIG. 10 illustrates an example of operation of cancelling the threshold voltage $V_{th2}$ included in the gate-source voltage $V_{gs}$ of the transistor $Tr_{21}$. Incidentally, in the present embodiment, to the high voltage line $L_{H2}$, as illustrated in Part (A) of FIG. 10, a pulse signal that drops from $V_{dd}$ to $V_{ss}$ in predetermined timing is applied, which is quite different from the first embodiment.

$V_{ss}$ is input into the input end IN of the buffer circuit 3 ($T_1$). Then, the voltage of the connection point A (the output end of the inverter circuit 10) becomes $V_{dd}$. Therefore, the transistor $Tr_{21}$ turns off, and the transistor $Tr_{22}$ turns on. At the time, the control signal AZ5 is $V_{dd}$ and further, the control signal AZ6 is $V_{ss}$. Thus, the transistor $Tr_{32}$ is off, and the transistor $Tr_{33}$ is on. Next, the control signal AZ5 becomes $V_{ss}$ ($T_2$), and the transistor $Tr_{32}$ turns on. Then, the voltage of the connection point E becomes $V_{ss}$. Subsequently, the control signal AZ6 becomes $V_{dd}$ ($T_3$), the transistor $Tr_{33}$ turns off, and then, the voltage of the high voltage line $L_{H2}$ rises from $V_{ss}$ to $V_{dd}$ ($T_4$). Then, a current flows in the transistors $Tr_{32}$ and $Tr_{22}$, the voltage of the connection point E gradually rises, and eventually reaches $V_{dd}+V_{th2}$ and at this moment, the transistor $Tr_{22}$ turns off. As a result, the voltage of the connection point E stops rising at $V_{dd}+V_{th2}$, and is maintained at $V_{dd}+V_{th2}$. In other words, by performing the above-described series of operations, the threshold voltage $V_{th2}$ of the transistor $Tr_{21}$ or a voltage corresponding to the threshold voltage $V_{th2}$ of the transistor $Tr_{21}$ is set in the gate of the transistor $Tr_{21}$ as an offset. As a result, even when there is a variation in the threshold voltage $V_{th2}$ of the transistor $Tr_{21}$, an output pulse of $V_{dd}$ is output from the output end OUT of the buffer circuit 3 accurately without a variation in width, according to the input pulse of $V_{dd}$ input into the input end IN of the buffer circuit 3. Therefore, in the timing of a rise from $V_{ss}$ to $V_{dd}$ in the output voltage of the buffer circuit 3, the variation can be reduced.

In this way, in the buffer circuit 3 of the present embodiment, the threshold voltage $V_{th2}$ of the transistor $Tr_{21}$ or a voltage corresponding to the threshold voltage $V_{th2}$ of the transistor $Tr_{21}$ is set in the gate of the transistor $Tr_{21}$ as an offset. As a result, a variation can be reduced in the timing of a rise in the output voltage of the buffer circuit 3.

Incidentally, when the buffer circuit 3 of the present embodiment is applied to, for example, an output stage of a scanner of an organic EL display device, a mobility correction period can be defined by the pulse width of the output voltage of the buffer circuit 3. This makes it possible to reduce a variation in the mobility correction period and therefore, a variation in the current flowing in the organic EL element at the time of light emission can be reduced and uniformity of intensity can be improved.

<Modification of Third Embodiment>

Figure 11:
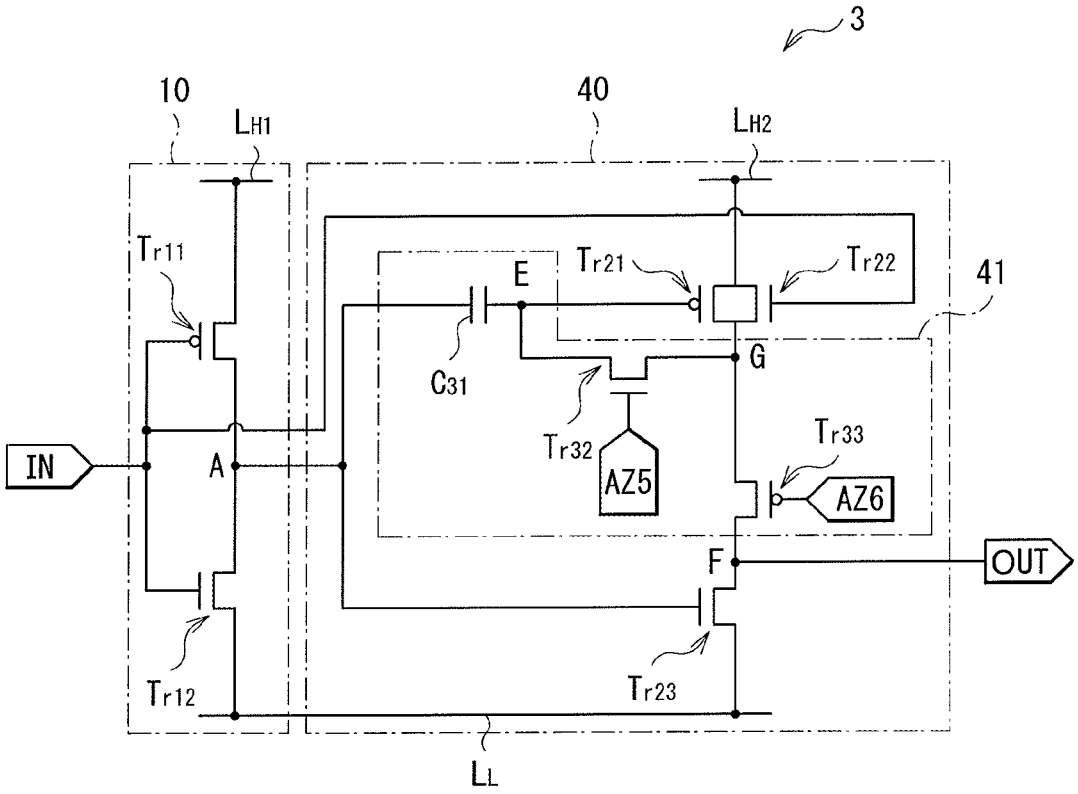
FIG. 11 is a circuit diagram illustrating another example of the buffer circuit in FIG. 9.
Figure 12:
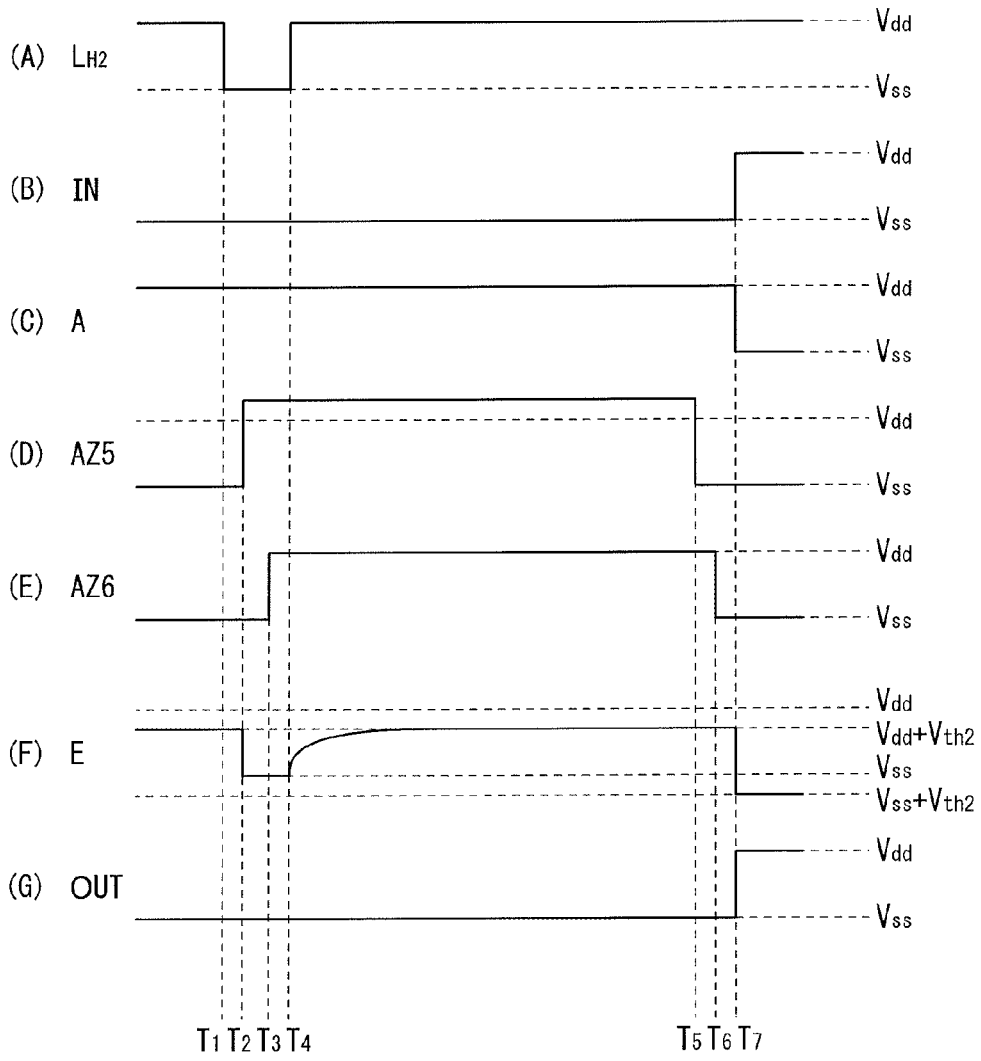
FIG. 12 is a waveform diagram illustrating an example of operation of the buffer circuit in FIG. 11.

In the third embodiment, the transistor $Tr_{32}$ is a p-channel MOS transistor, but the electro-conductive type of this transistor $Tr_{32}$ may be reversed. Specifically, as illustrated in FIG. 11, the transistor $Tr_{32}$ may be an n-channel MOS transistor. In this case however, as illustrated in FIG. 12, the signal waveform of the control signal AZ5 is desired to be the inverse of the signal waveform of the control signal AZ5 illustrated in FIG. 10.

<Fourth Embodiment>

Figure 13:
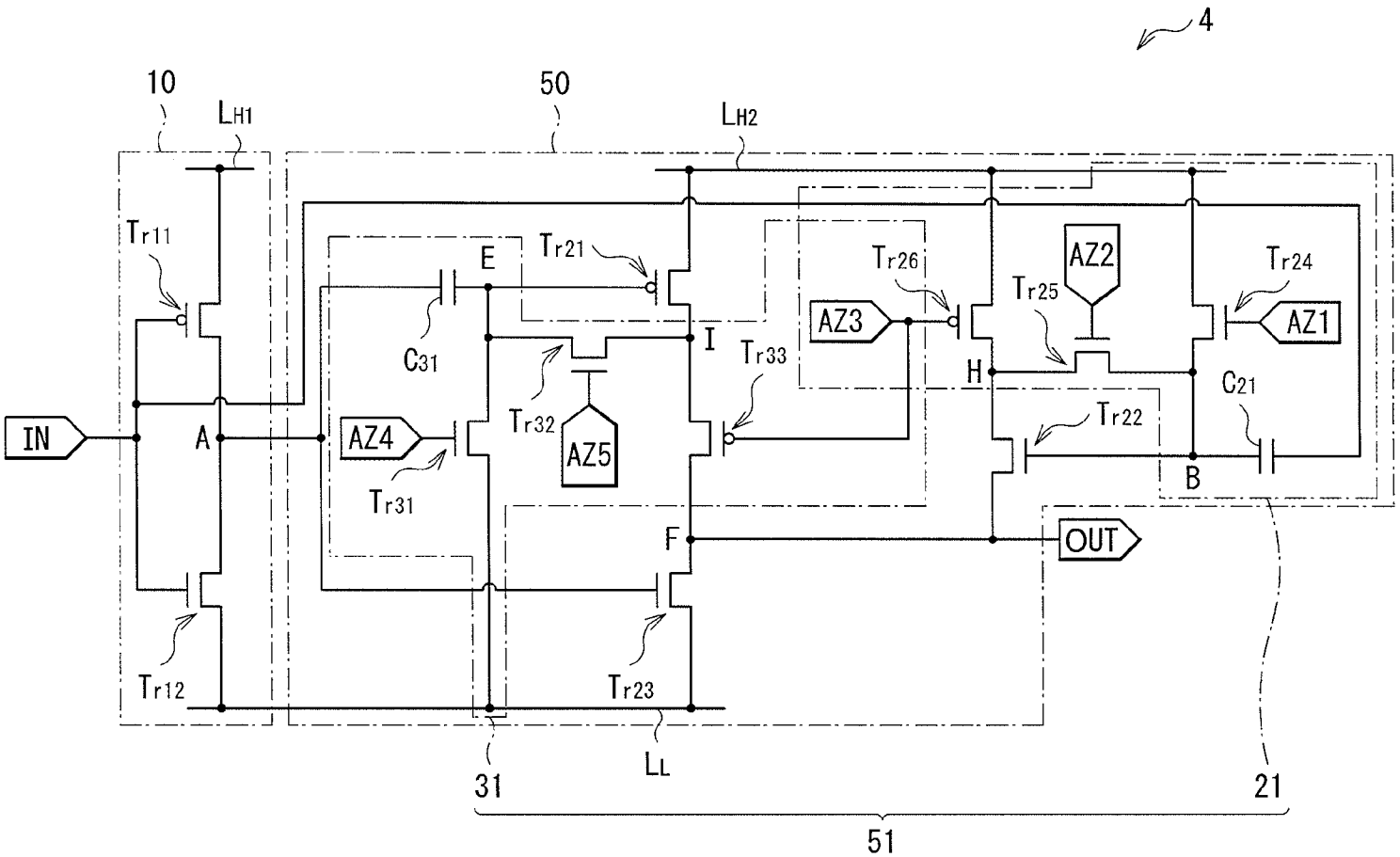
FIG. 13 is a circuit diagram illustrating an example of a buffer circuit according to a fourth embodiment of the present invention.

Next, a buffer circuit 4 (drive circuit) according to the fourth embodiment will be described. FIG. 13 illustrates an example of the entire structure of the buffer circuit 4. Like the above-described buffer circuits 1 and 2, the buffer circuit 4 outputs, from an output end OUT, a pulse signal approximately in phase with a pulse signal input into an input end IN. The buffer circuit 4 includes the inverter circuit 10 (input-side inverter circuit) and an inverter circuit 50 (output-side inverter circuit).

The inverter circuit 50 outputs a pulse signal whose signal waveform is approximately the inverse of the signal waveform of the input pulse signal. The inverter circuits 10 and 50 are connected to each other in series. The inverter circuit 10 is arranged on the input end IN side in the relationship with the inverter circuit 50, and the input end of the inverter circuit 10 corresponds to the input end IN of the buffer circuit 4. On the other hand, the inverter circuit 50 is arranged on the output end OUT side in the relationship with the inverter circuit 10, and an output end of the inverter circuit 50 corresponds to the output end OUT of the buffer circuit 4. The output end (a point corresponding to A in the figure) of the inverter circuit 10 is connected to an input end of the inverter circuit 50, and the buffer circuit 4 is configured such that an output of the inverter circuit 10 is input into the inverter circuit 50. The inverter circuit 50 is inserted between the high voltage line $L_{H2}$ and the low voltage line $L_L$.

The inverter circuit 50 has a circuit configuration similar to that of the inverter circuit 30 of the second embodiment except that a threshold correction circuit 51 is provided in place of the threshold correction circuit 31. Here, the threshold correction circuit 51 is a combination of the threshold correction circuit 21 of the first embodiment and the threshold correction circuit 31 of the second embodiment. Incidentally, when the threshold correction circuits 21 and 31 are combined, the respective drains of the transistors $Tr_{21}$ and $Tr_{22}$ are separated from each other and also, the respective sources of the transistors $Tr_{21}$ and $Tr_{22}$ are separated from each other. Further, the drain of the transistor $Tr_{21}$ is directly connected to the high voltage line $L_{H2}$, and the drain of the transistor $Tr_{22}$ is connected to a connection point H between the source or the drain of the transistor $Tr_{26}$ and the source or the drain of the transistor $Tr_{25}$. Furthermore, the source of the transistor $Tr_{22}$ is directly connected to the output end OUT of the buffer circuit 4, and the source of the transistor $Tr_{21}$ is connected to a connection point I between the source or the drain of the transistor $Tr_{32}$ and the source or the drain of the transistor $Tr_{33}$.

Further, the control signal AZ3 doubles as the control signal AZ6, thereby serving as a common signal. Furthermore, the control signals AZ1 and AZ4 are equal to each other, and the control signals AZ2 and AZ5 are equal to each other. Incidentally, the transistor $Tr_{24}$ is a second electro-conductive type transistor, e.g. an n-channel MOS transistor.

[Operation]

Next, operation of the buffer circuit 4 in the present embodiment will be described. In the following, a threshold correction ($V_{th}$ cancel) in the buffer circuit 4 will be mainly described.

Figure 14:
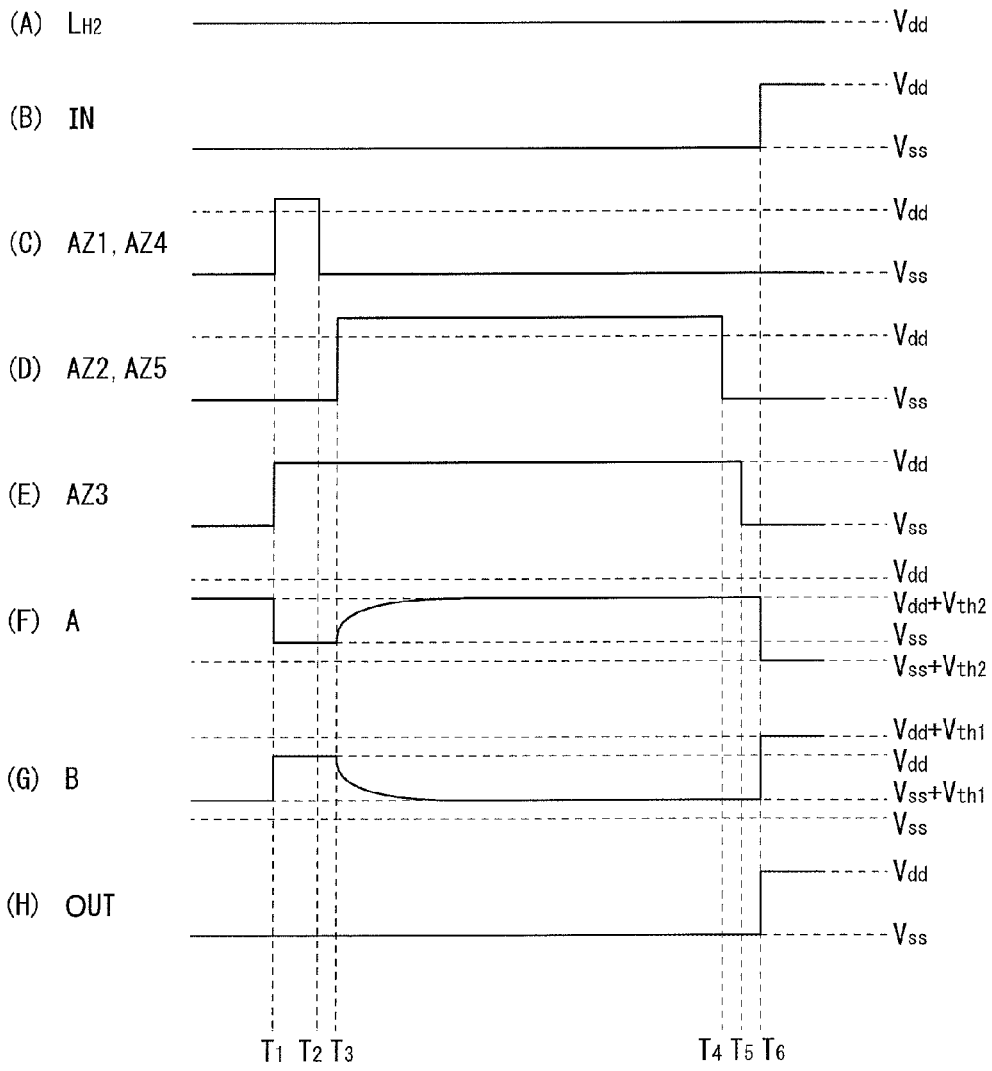
FIG. 14 is a waveform diagram illustrating an example of operation of the buffer circuit in FIG. 13.

FIG. 14 illustrates an example of the operation of the buffer circuit 4. FIG. 14 illustrates an example of operation of cancelling the threshold voltages $V_{th1}$ and $V_{th2}$ included in the gate-source voltage $V_{gs}$ of each of the transistors $Tr_{21}$ and $Tr_{22}$. Incidentally, the voltage of the high voltage line $L_{H2}$ is assumed to remain, as illustrated in Part (A) of FIG. 14, at a constant value ($V_{dd}$) during this operation.

Initially, $V_{ss}$ is input into the input end IN of the buffer circuit 4, the voltage of the connection point A (the output end of the inverter circuit 10) is $V_{dd}+V_{th2}$, and the voltage of the connection point B is $V_{ss}$. Therefore, both of the transistors $Tr_{21}$ and $Tr_{22}$ are off. At the time, both of the control signals AZ1 and AZ4 are $V_{ss}$, both of the control signals AZ2 and AZ5 also are $V_{ss}$, and the control signal AZ3 also is $V_{ss}$. Therefore, the transistors $Tr_{24}$, $Tr_{25}$, $Tr_{31}$ and $Tr_{32}$ are off, and the transistors $Tr_{26}$ and $Tr_{33}$ are on. Next, the control signals AZ1 and AZ4 become $V_{dd}$, the control signal AZ3 becomes $V_{dd}$ ($T_1$), the transistors $Tr_{24}$ and $Tr_{31}$ turn on, and the transistors $Tr_{26}$ and $Tr_{33}$ turn off. Then, the voltage of the connection point A becomes $V_{ss}$, and the voltage of the connection point B becomes $V_{dd}$. Subsequently, the control signals AZ1 and AZ4 become $V_{ss}$ ($T_2$), the transistors $Tr_{24}$ and $Tr_{31}$ turn off, and then, the control signals AZ2 and AZ5 become values slightly larger than $V_{dd}$ ($T_3$), and the transistors $Tr_{25}$ and $Tr_{32}$ turn on. Then, a current flows in the transistors $Tr_{32}$ and $Tr_{21}$, the voltage of the connection point A gradually rises, and eventually reaches $V_{dd}+V_{th2}$ and at this moment, the transistor $Tr_{21}$ turns off. As a result, the voltage of the connection point A stops rising at $V_{dd}+V_{th2}$, and is maintained at $V_{dd}+V_{th2}$. On the other hand, a current also flows in the transistors $Tr_{25}$ and $Tr_{22}$, the voltage of the connection point B gradually falls, and eventually reaches $V_{ss}+V_{th1}$ and at this moment, the transistor $Tr_{22}$ turns off. As a result, the voltage of the connection point B stops falling at $V_{ss}+V_{th1}$, and is maintained at $V_{ss}+V_{th1}$. In other words, by performing the above-described series of operations, the threshold voltage $V_{th2}$ of the transistor $Tr_{21}$ or a voltage corresponding to the threshold voltage $V_{th2}$ of the transistor $Tr_{21}$ is set in the gate of the transistor $Tr_{21}$ as an offset, and the threshold voltage $V_{th1}$ of the transistor $Tr_{22}$ or a voltage corresponding to the threshold voltage $V_{th1}$ of the transistor $Tr_{22}$ is set in the gate of the transistor $Tr_{22}$ as an offset. As a result, even when there is a variation in the threshold voltage $V_{th2}$ of the transistor $Tr_{21}$, an output pulse of $V_{dd}$ is output from the output end OUT of the buffer circuit 4 accurately without a variation in width, according to the input pulse of $V_{dd}$ input into the input end IN of the buffer circuit 4. Further, even when there is a variation in the threshold voltage $V_{th1}$ of the transistor $Tr_{22}$, an output pulse of $V_{dd}$ is output from the output end OUT of the buffer circuit 4 accurately without a variation in width, according to the input pulse of $V_{dd}$ input into the input end IN of the buffer circuit 4. Therefore, in the timing of a rise from $V_{ss}$ to $V_{dd}$ in the output voltage of the buffer circuit 4, the variation can be reduced.

In this way, in the buffer circuit 4 of the present embodiment, the threshold voltage $V_{th2}$ of the transistor $Tr_{21}$ or a voltage corresponding to the threshold voltage $V_{th2}$ of the transistor $Tr_{21}$ is set in the gate of the transistor $Tr_{21}$ as an offset. Further, the threshold voltage $V_{th1}$ of the transistor $Tr_{22}$ or a voltage corresponding to the threshold voltage $V_{th1}$ of the transistor $Tr_{22}$ is set in the gate of the transistor $Tr_{22}$ as an offset. As a result, a variation can be reduced in the timing of a rise in the output voltage of the buffer circuit 4.

Incidentally, when the buffer circuit 4 of the present embodiment is applied to, for example, an output stage of a scanner of an organic EL display device, a mobility correction period can be defined by the pulse width of the output voltage of the buffer circuit 4. This makes it possible to reduce a variation in the mobility correction period and therefore, a variation in the current flowing in the organic EL display device at the time of light emission can be reduced and uniformity of intensity can be improved.

<Modification of Fourth Embodiment>

Figure 15:
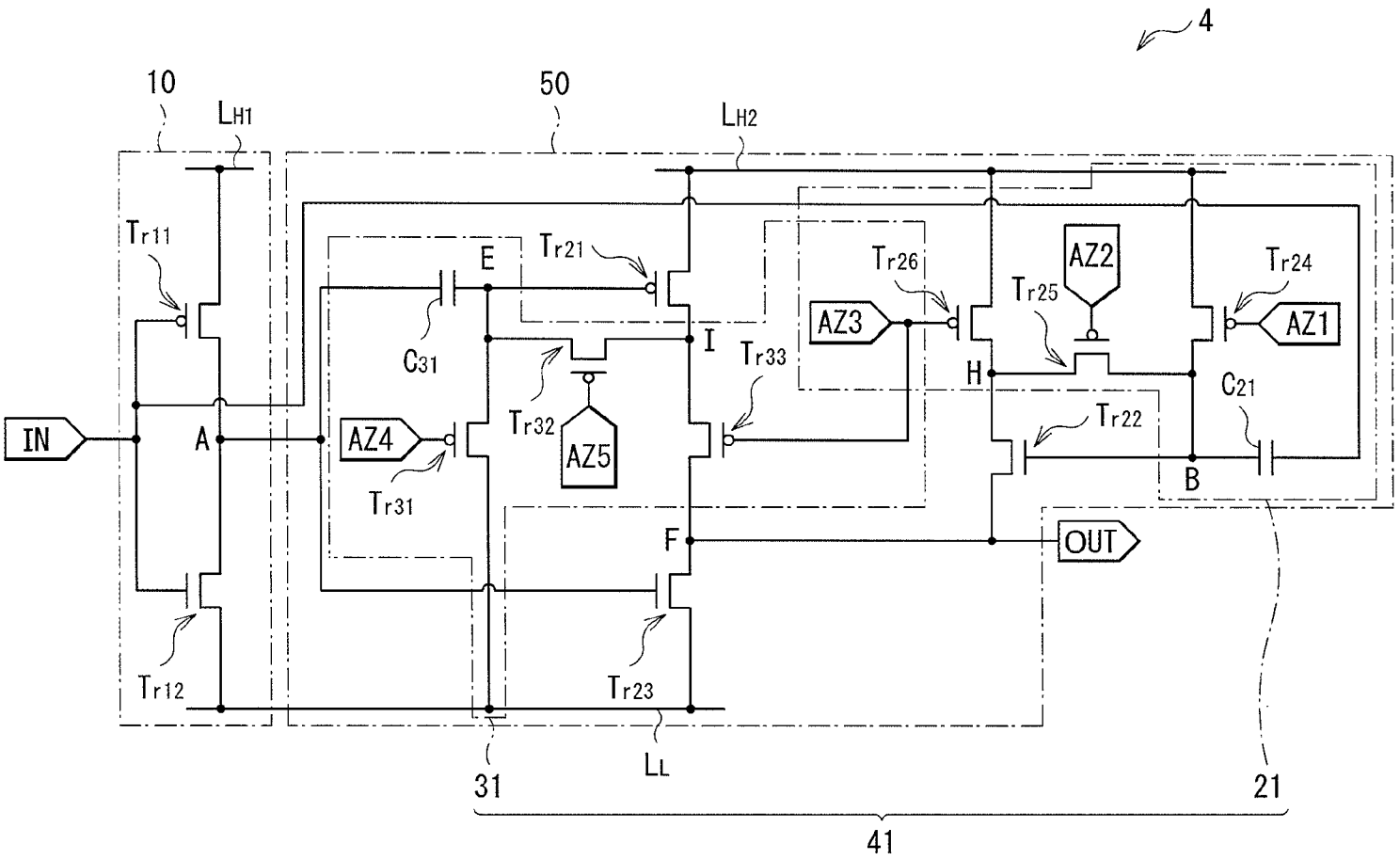
FIG. 15 is a circuit diagram illustrating another example of the buffer circuit in FIG. 13.
Figure 16:
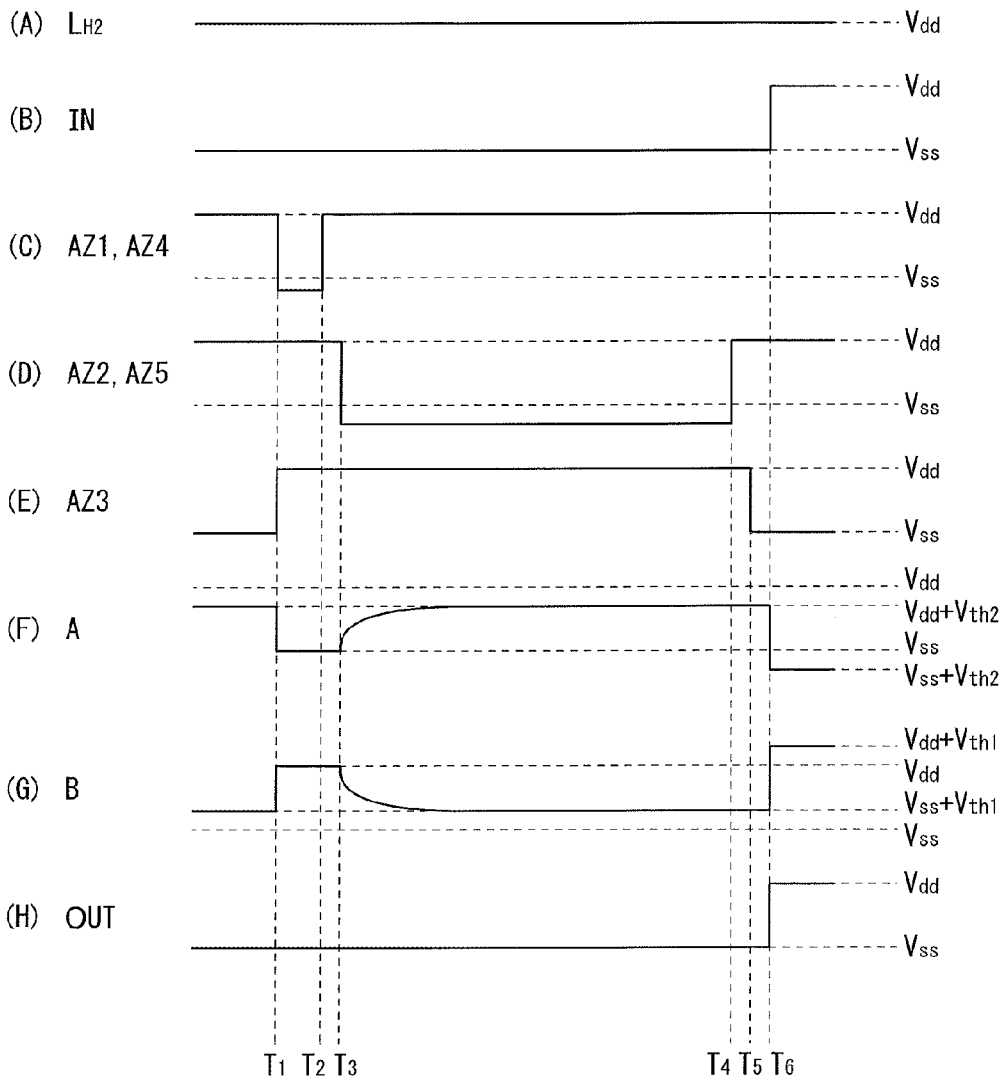
FIG. 16 is a waveform diagram illustrating an example of operation of the buffer circuit in FIG. 15.

In the fourth embodiment, each of the transistors $Tr_{24}$, $Tr_{25}$, $Tr_{31}$ and $Tr_{32}$ is an n-channel MOS transistor, but the electroconductive types of these transistors $Tr_{24}$, $Tr_{25}$, $Tr_{31}$ and $Tr_{32}$ may be all reversed. Specifically, as illustrated in FIG. 15, each of the transistors $Tr_{24}$, $Tr_{25}$, $Tr_{31}$ and $Tr_{32}$ may be a p-channel MOS transistor. In this case however, as illustrated in FIG. 16, the signal waveforms of the control signals AZ1, AZ2, AZ4 and AZ5 are desired to be the inverse of the signal waveforms of the control signals AZ1, AZ2, AZ4 and AZ5 illustrated in FIG. 14.

APPLICATION EXAMPLE

Figure 17:
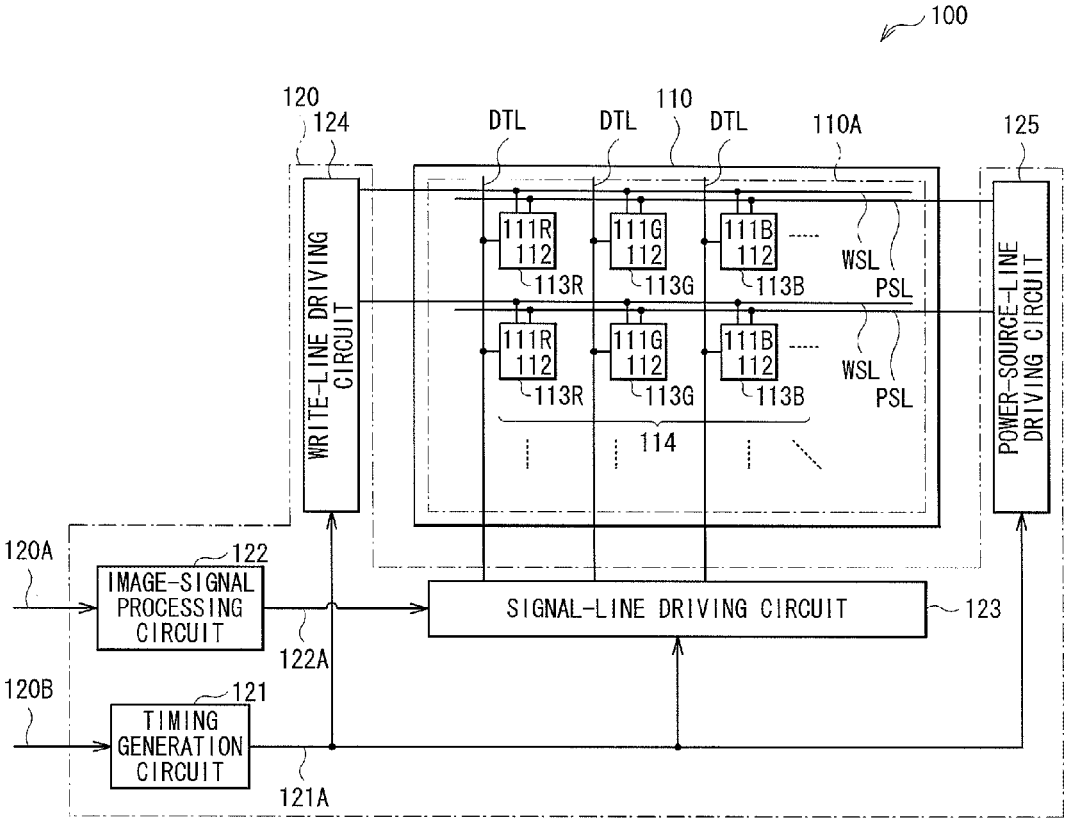
FIG. 17 is a schematic structural diagram of a display device that is an example of an application example of the buffer circuit according to each of the above-mentioned embodiments.

FIG. 17 illustrates an example of the entire structure of a display device 100 serving as an example of the application example of the buffer circuits 1 through 4 according to the above-described respective embodiments. This display device 100 includes, for example, a display panel 110 (display section) and a drive circuit 120 (drive section).

(Display Panel 110)

The display panel 110 includes a display region 110A in which three kinds of organic EL elements 111R, 111G and 111B emitting mutually different colors are arranged two-dimensionally. The display region 110A is a region for displaying an image by using light emitted from the organic EL elements 111R, 111G and 111B. The organic EL element 111R is an organic EL element emitting red light, the organic EL element 111G is an organic EL element emitting green light, and the organic EL element 111B is an organic EL element emitting blue light. Incidentally, in the following, the organic EL elements 111R, 111G and 111B will be collectively referred to as an organic EL element 111 as appropriate.

(Display Region 110A)

Figure 18:
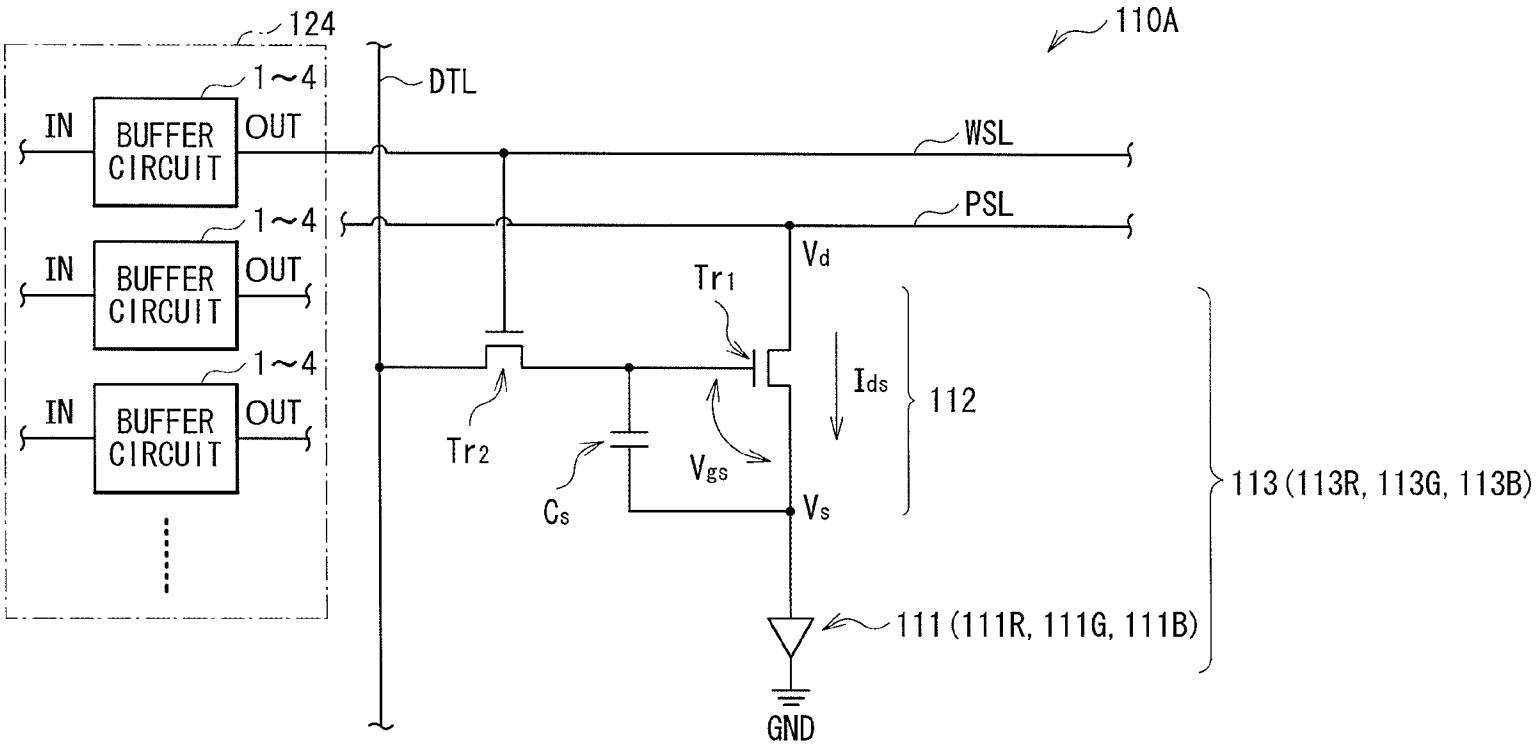
FIG. 18 is a circuit diagram illustrating an example of a write-line driving circuit and an example of a pixel circuit in FIG. 17.

FIG. 18 illustrates an example of a circuit configuration within the display region 110A, together with an example of a write-line driving circuit 124 to be described later. In the display region 110A, plural pixel circuits 112 respectively paired with the individual organic EL elements 111 are arranged two-dimensionally. In the present application example, a pair of the organic EL element 111 and the pixel circuit 112 implements one pixel 113. To be more specific, as illustrated in FIG. 18, a pair of the organic EL element 111R and the pixel circuit 112 implement one pixel 113R for red, a pair of the organic EL element 111G and the pixel circuit 112 implement one pixel 113G for green, and a pair of the organic EL element 111B and the pixel circuit 112 implement one pixel 113B for blue. Further, the adjacent three pixels 113R, 113G and 113B implement one display pixel 114.

Each of the pixel circuits 112 includes, for example, a drive transistor $Tr_1$ controlling a current flowing in the organic EL element 111, a write transistor $Tr_2$ writing a voltage of a signal line DTL into the drive transistor $Tr_1$, and a holding capacitance $C_s$, and thus each of the pixel circuits 112 has a 2Tr1C circuit configuration. The drive transistor $Tr_1$ and the write transistor $Tr_2$ are each formed by, for example, an n-channel MOS Thin Film Transistor (TFT). The drive transistor $Tr_1$ or the write transistor $Tr_2$ may be a p-channel MOS TFT.

In the display region 110A, plural write lines WSL (scanning line) are arranged in rows and plural signal lines DTL are arranged in columns. In the display region 110A, further, plural power-source lines PSL (member to which a source voltage is supplied) are arranged in rows along the write lines WSL. Near a cross-point between each signal line DTL and each write line WSL, one organic EL element 111 is provided. Each of the signal lines DTL is connected to an output end (not illustrated) of a signal-line driving circuit 123 to be described later, and to either of a drain electrode and a source electrode (not illustrated) of the write transistor $Tr_2$. Each of the write lines WSL is connected to an output end (not illustrated) of the write-line driving circuit 124 to be described later and to a gate electrode (not illustrated) of the write transistor $Tr_2$. Each of the power-source lines PSL is connected to an output end (not illustrated) of a power-source-line driving circuit 125 to be described later, and to either of a drain electrode and a source electrode (not illustrated) of the drive transistor $Tr_1$. Of the drain electrode and the source electrode of the write transistor $Tr_2$, one (not illustrated) that is not connected to the signal line DTL is connected to a gate electrode (not illustrated) of the drive transistor $Tr_1$ and one end of the holding capacitance $C_s$. Of the drain electrode and the source electrode of the drive transistor $Tr_1$, one (not illustrated) that is not connected to the power-source line PSL and the other end of the holding capacitance $C_s$ are connected to an anode electrode (not illustrated) of the organic EL element 111. A cathode electrode (not illustrated) of the organic EL element 111 is connected to, for example, a ground line GND.

(Drive Circuit 120)

Next, each circuit in the drive circuit 120 will be described with reference to FIG. 17 and FIG. 18. The drive circuit 120 includes a timing generation circuit 121, an image-signal processing circuit 122, the signal-line driving circuit 123, the write-line driving circuit 124 and the power-source-line driving circuit 125.

The timing generation circuit 121 performs control so that the image-signal processing circuit 122, the signal-line driving circuit 123, the write-line driving circuit 124 and the power-source-line driving circuit 125 operate in an interlocking manner. For example, the timing generation circuit 121 is configured to output a control signal 121A to each of the above-described circuits, according to (in synchronization with) a synchronization signal 20B input externally.

The image-signal processing circuit 122 makes a predetermined correction to an image signal 120A input externally, and outputs a corrected image signal 122A to the signal-line driving circuit 123. As the predetermined correction, there are, for example, a gamma correction and an overdrive correction.

The signal-line driving circuit 123 applies, according to (in synchronization with) the input of the control signal 121A, the image signal 122A (signal voltage $V_{sig}$) input from the image-signal processing circuit 122, to each of the signal lines DTL, thereby performing writing into the pixel 113 to be selected. Incidentally, the writing refers to the application of a predetermined voltage to the gate of the drive transistor $Tr_1$.

The signal-line driving circuit 123 is configured to include, for example, a shift resistor (not illustrated), and includes a buffer circuit (not illustrated) for one stage, corresponding to each column of the pixels 113. This signal-line driving circuit 123 can output two kinds of voltages ($V_{ofs}$, $V_{sig}$) to each of the signal lines DTL, according to (in synchronization with) the input of the control signal 121A. Specifically, the signal-line driving circuit 123 supplies, via the signal line DTL connected to each of the pixels 113, the two kinds of voltages ($V_{ofs}$, $V_{sig}$) to the pixel 113 selected by the write-line driving circuit 124.

Here, the offset voltage $V_{ofs}$ is a value lower than a threshold voltage $V_{e1}$ of the organic EL element 111. Further, the signal voltage $V_{sig}$ is a value corresponding to the image signal 122A. A minimum voltage of the signal voltage $V_{sig}$ is a value lower than the offset voltage $V_{ofs}$, and a maxim voltage of the signal voltage $V_{sig}$ is a value higher than the offset voltage $V_{ofs}$.

The write-line driving circuit 124 is configured to include, for example, a shift resistor (not illustrated), and includes a buffer circuit 1, a buffer circuit 2, a buffer circuit 3, or a buffer circuit 4 for each stage, corresponding to each row of the pixels 113. This write-line driving circuit 124 can output two kinds of voltages ($V_{dd}$, $V_{ss}$) to each of the write lines WSL, according to (in synchronization with) the input of the control signal 121A. Specifically, the write-line driving circuit 124 supplies, via the write line WSL connected to each of the pixels 113, the two kinds of voltages ($V_{dd}$, $V_{ss}$) to the pixel 113 to be driven, thereby controlling the write transistor $Tr_2$.

Here, the voltage $V_{dd}$ is a value equal to or higher than an ON voltage of the write transistor $Tr_2$. $V_{dd}$ is a value output from the write-line driving circuit 124 at the time of extinction or at the time of a threshold correction to be described later. $V_{ss}$ is a value lower than the ON voltage of the write transistor $Tr_2$, and also lower than $V_{dd}$.

The power-source-line driving circuit 125 is configured to include, for example, a shift resistor (not illustrated), and includes, for example, a buffer circuit (not illustrated) for each stage, corresponding to each row of the pixels 113. This power-source-line driving circuit 125 can output two kinds of voltages ($V_{ccH}$, $V_{ccL}$) according to (in synchronization with) the input of the control signal 121A. Specifically, the power-source-line driving circuit 125 supplies, via the power-source line PSL connected to each of the pixels 113, the two kinds of voltages ($V_{ccH}$, $V_{ccL}$) to the pixel 113 to be driven, thereby controlling the light emission and extinction of the organic EL element 111.

Here, the voltage $V_{ccL}$ is a value lower than a voltage ($V_{e1}+V_{ca}$) that is the sum of the threshold voltage $V_{e1}$ of the organic EL element 111 and a voltage $V_{ca}$ of a cathode of the organic EL element 111. Further, the voltage $V_{ccH}$ is a value equal to or higher than the voltage ($V_{e1}+V_{ca}$).

Next, an example of the operation (operation from extinction to light emission) of the display device 100 according to the present application example will be described. In the present application example, in order that even when a threshold voltage $V_{th}$ or a mobility μ of the drive transistor $Tr_1$ changes over time, light emission intensity of the organic EL element 111 may remain constant without being affected by such a change, correction operation for the change of the threshold voltage $V_{th}$ or the mobility μ is incorporated.

Figure 19:
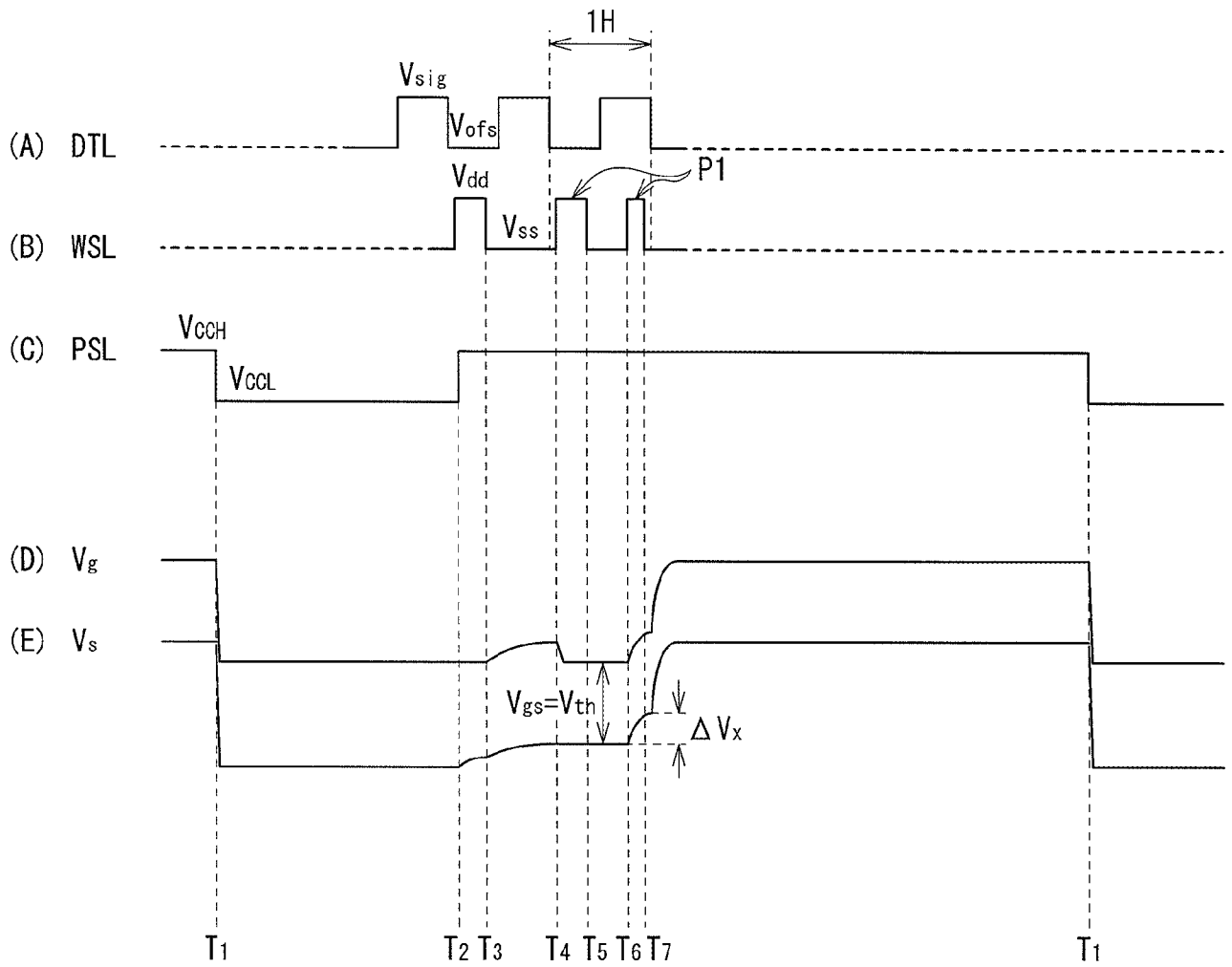
FIG. 19 is a waveform diagram illustrating an example of operation of the display device in FIG. 17.
Figure 20:
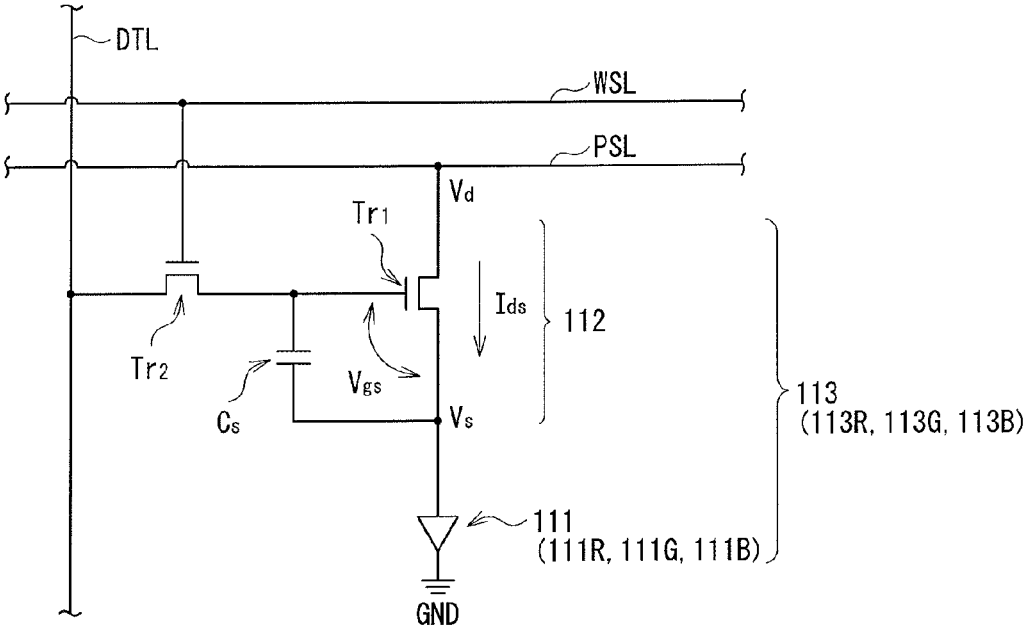
FIG. 20 PRIOR ART
FIG. 20 is a circuit diagram illustrating an example of a pixel circuit of a display device in related art.

FIG. 19 illustrates an example of the waveform of a voltage applied to the pixel circuit 112 and an example of a change in each of a gate voltage $V_g$ and a source voltage $V_s$ of the drive transistor $Tr_1$. In Part (A) of FIG. 19, there is illustrated a state in which the signal voltage $V_{sig}$ and the offset voltage $V_{ofs}$ are applied to the signal line DTL. In Part (B) of FIG. 19, there is illustrated a state in which the voltage $V_{dd}$ for turning on the drive transistor $Tr_1$ and the voltage $V_{ss}$ for turning off the drive transistor $Tr_1$ are applied to the write line WSL. In Part (C) of FIG. 19, there is illustrated a state in which the high voltage $V_{ccH}$ and the low voltage $V_{ccL}$ are applied to the power-source line PSL. Further, in Part (D) and Part (E) of FIG. 19, there is illustrated a state in which the gate voltage $V_g$ and the source voltage $V_s$ of the drive transistor $Tr_1$ change over time in response to the application of the voltages to the power-source line PSL, the signal line DTL and the write line WSL.

($V_{th}$ Correction Preparation Period)

First, a preparation for the $V_{th}$ correction is made. Specifically, when the voltage of the write line WSL is $V_{off}$, the voltage of the signal line DTL is $V_{sig}$, and the voltage of the power-source line PSL is $V_{ccH}$ (in other words, when the organic EL element 111 is emitting light), the power-source-line driving circuit 125 reduces the voltage of the power-source line PSL from $V_{ccH}$ to $V_{ccL}$ ($T_1$). Then, the source voltage $V_s$ becomes $V_{ccL}$, and the organic EL element 111 stops emitting the light. Next, the signal-line driving circuit 123 switches the voltage of the signal line DTL from $V_{sig}$ to $V_{ofs}$ and subsequently, while the voltage of the power-source line PSL is $V_{ccH}$, the write-line driving circuit 124 increases the voltage of the write line WSL from $V_{off}$ to $V_{on}$. Then, the gate voltage $V_g$ drops to $V_{ofs}$. At the time, in the power-source-line driving circuit 125 and the signal-line driving circuit 123, the voltages ($V_{ccL}$, $V_{ofs}$) applied to the power-source line PSL and the signal line DTL are set so that the gate-source voltage $V_{gs}$ ($=V_{ofs}-V_{ccL}$) is higher than the threshold voltage $V_{th}$ of the drive transistor $Tr_1$.

(First $V_{th}$ Correction Period)

Next, the correction of $V_{th}$ is performed. Specifically, while the voltage of the signal line DTL is $V_{ofs}$, the power-source-line driving circuit 125 increases the voltage of the power-source line PSL from $V_{ccL}$ to $V_{ccH}$ ($T_2$). Then, a current $I_{ds}$ flows between the drain and the source of the drive transistor $Tr_1$, and the source voltage $V_s$ rises. Subsequently, before the signal-line driving circuit 123 switches the voltage of the signal line DTL from $V_{ofs}$ to $V_{sig}$, the write-line driving circuit 124 reduces the voltage of the write line WSL from $V_{on}$ to $V_{off}$ ($T_3$). Then, the gate of the drive transistor $Tr_1$ enters a floating state, and the correction of $V_{th}$ stops.

(First $V_{th}$ Correction Stop Period)

In a period during which the $V_{th}$ correction is stopped, for example, in other line (pixel) different from the line (pixel) to which the previous correction is made, the voltage of the signal line DTL is sampled. Incidentally, at the time, in the line (pixel) to which the previous $V_{th}$ correction is made, the source voltage $V_s$ is lower than $V_{ofs}-V_{th}$. Therefore, during the $V_{th}$ correction stop period as well, in the line (pixel) to which the previous $V_{th}$ correction is made, the current $I_{ds}$ flows between the drain and the source of the drive transistor $Tr_1$, the source voltage $V_s$ rises, and the gate voltage $V_g$ also rises due to coupling via the holding capacitance $C_s$.

(Second $V_{th}$ Correction Period)

Next, the $V_{th}$ correction is made again. Specifically, when the voltage of the signal line DTL is $V_{ofs}$ and the $V_{th}$ correction is possible, the write-line driving circuit 124 increases the voltage of the write line WSL from $V_{off}$ to $V_{on}$, thereby causing the gate of the drive transistor $Tr_1$ to be $V_{ofs}$ ($T_4$). At the time, when the source voltage $V_s$ is lower than $V_{ofs}-V_{th}$ (when the $V_{th}$ correction is not completed yet), the current $I_{ds}$ flows between the drain and the source of the drive transistor $Tr_1$, until the drive transistor $Tr_1$ is cut off (until the gate-source voltage $V_{gs}$ becomes $V_{th}$). Subsequently, before the signal-line driving circuit 123 switches the voltage of the signal line DTL from $V_{ofs}$ to $V_{sig}$, the write-line driving circuit 124 reduces the voltage of the write line WSL from $V_{on}$ to $V_{off}$ ($T_5$). Then, the gate of the drive transistor $Tr_1$ enters a floating state and thus, it may be possible to keep the gate-source voltage $V_{gs}$ constant, regardless of the magnitude of the voltage of the signal line DTL.

Incidentally, during this $V_{th}$ correction period, when the holding capacitance $C_s$ is charged to be $V_{th}$, and the gate-source voltage $V_{gs}$ becomes $V_{th}$, the drive circuit 120 completes the $V_{th}$ correction. However, when the gate-source voltage $V_{gs}$ does not reach $V_{th}$, the drive circuit 120 repeats the $V_{th}$ correction and the $V_{th}$ correction stop, until the gate-source voltage $V_{gs}$ reaches $V_{th}$.

(Writing and μ Correction Period)

After the $V_{th}$ correction stop period ends, the writing and the μ correction are performed. Specifically, while the voltage of the signal line DTL is $V_{sig}$, the write-line driving circuit 124 increases the voltage of the write line WSL from $V_{off}$ to $V_{on}$ ($T_6$), and connects the gate of the drive transistor $Tr_1$ to the signal line DTL. Then, the gate voltage $V_g$ of the drive transistor $Tr_1$ becomes the voltage $V_{sig}$ of the signal line DTL. At the time, an anode voltage of the organic EL element 111 is still smaller than the threshold voltage $V_{e1}$ of the organic EL element 111 at this stage, and the organic EL element 111 is cut off. Therefore, the current $I_{ds}$ flows in an element capacitance (not illustrated) of the organic EL element 111 and therefore the element capacitance is charged and thus, the source voltage $V_s$ rises by $\Delta V_x$, and the gate-source voltage $V_{gs}$ becomes $V_{sig}+V_{th}-\Delta V_x$. In this way, the μ correction is performed concurrently with the writing. Here, the larger the mobility μ of the drive transistor $Tr_1$ is, the larger $\Delta V_x$ is. Therefore, by reducing the gate-source voltage $V_{gs}$ by $\Delta V_x$, a variation in the mobility μ for each pixel 113 can be removed.

(Light Emission Period)

Lastly, the write-line driving circuit 124 reduces the voltage of the write line WSL from $V_{on}$ to $V_{off}$ ($T_8$). Then, the gate of the drive transistor $Tr_1$ enters a floating state, the current $I_{ds}$ flows between the drain and the source of the drive transistor $Tr_1$, and the source voltage $V_s$ rises. As a result, a voltage equal to or higher than the threshold voltage $V_{e1}$ is applied to the organic EL element 111, and the organic EL element 111 emits light of desired intensity.

In the display device 100 of the present application example, as described above, the pixel circuit 112 is subjected to on-off control in each pixel 113, and the driving current is fed into the organic EL element 111 of each pixel 113, so that positive holes and electrons recombine and therefore emission of light occurs, and this light is extracted to the outside. As a result, an image is displayed in the display region 110A of the display panel 110.

Figure 21:
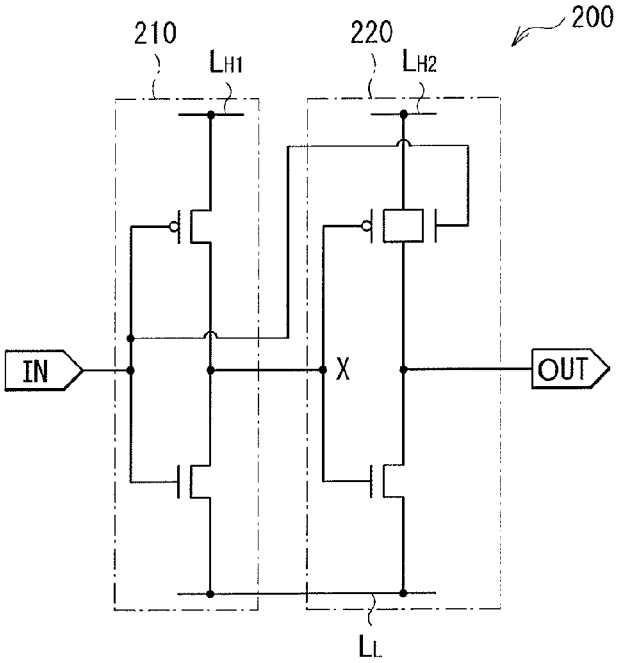
FIG. 21 PRIOR ART
FIG. 21 is a circuit diagram illustrating an example of a buffer circuit in related art.
Figure 22:
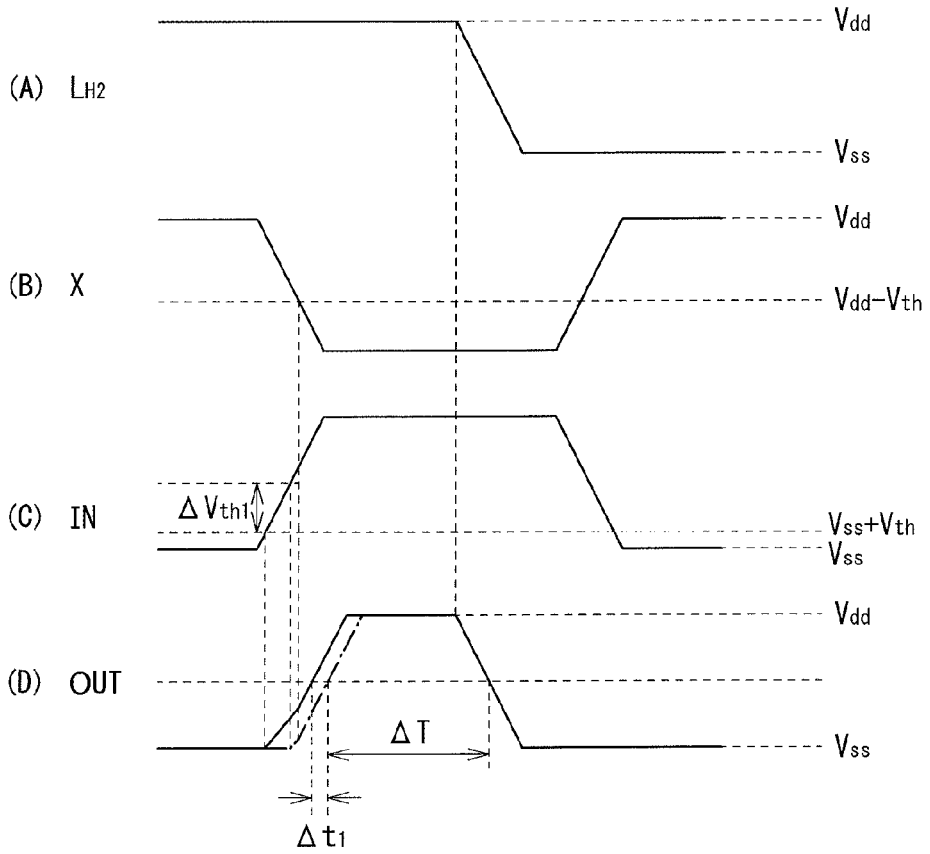
FIG. 22 PRIOR ART
FIG. 22 is a waveform diagram illustrating an example of operation of the buffer circuit in FIG. 21.
Figure 23:
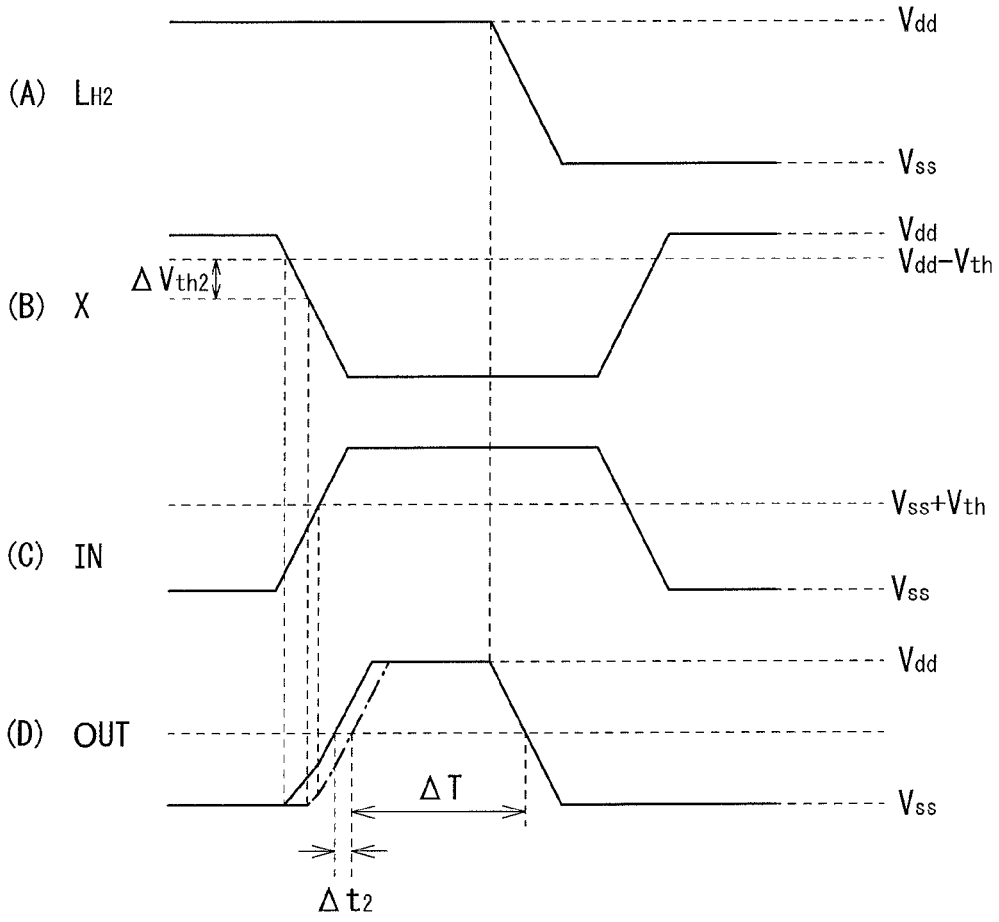
FIG. 23 PRIOR ART
FIG. 23 is a waveform diagram illustrating another example of the operation of the buffer circuit in FIG. 21.
Figure 24:
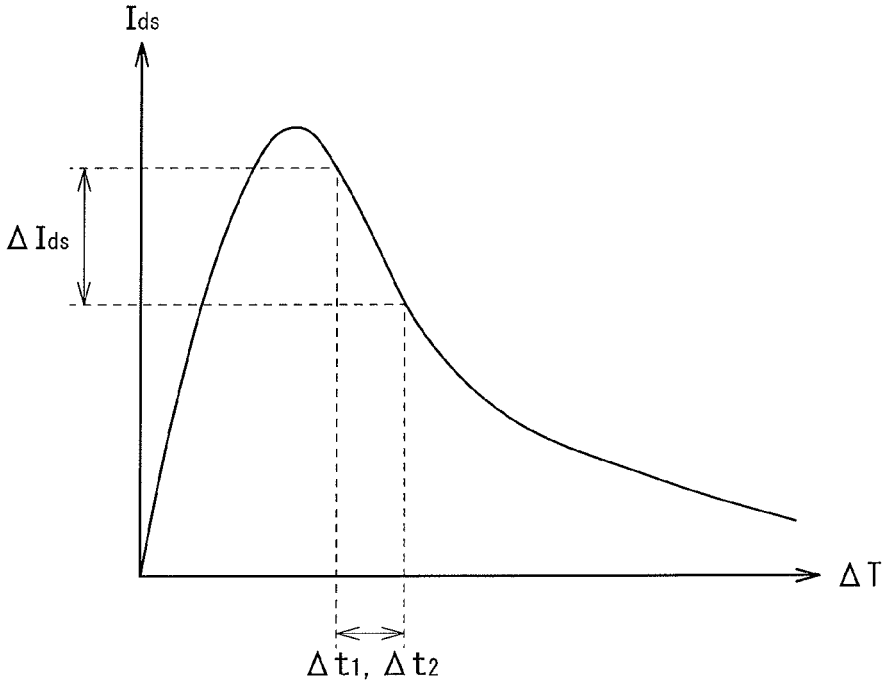
FIG. 24 PRIOR ART
FIG. 24 is a diagram illustrating an example of a relationship between mobility correction time and display intensity.

Incidentally, in related art, in the display device of the active matrix system, typically, as illustrated in FIG. 21, the buffer circuit within the scan circuit is configured by connecting the two inverter circuits 210 and 220 in series. However, in the buffer circuit 200, for example, as illustrated in FIG. 22, when the threshold voltage $V_{th1}$ of the p-channel MOS transistor varies by $\Delta V_{th1}$, the timing of a rise in the voltage $V_{out}$ of the output OUT is shifted by $\Delta t_1$. Further, in the buffer circuit 200, for example, as illustrated in FIG. 23, when the threshold voltage $V_{th2}$ of the n-channel MOS transistor varies by $\Delta V_{th2}$, the timing of a drop in the voltage $V_{out}$ of the output OUT is shifted by $\Delta t_2$. Therefore, for example, there is such a problem that when the timing of a rise and the timing of a drop in the voltage $V_{out}$ of the output OUT vary and the mobility correction period ΔT varies by $\Delta t_1+\Delta t_2$, the current $I_{ds}$ at the time of light emission varies by $\Delta I_{ds}$ as illustrated in, for example, FIG. 24, and this variation leads to a variation in intensity.

On the other hand, in the present application example, the buffer circuits 1 to 4 according to each of the above-described embodiments are used in an output stage of the write-line driving circuit 124. Thus, the mobility correction period can be defined with the pulse width of an output voltage of the buffer circuits 1 to 4. This makes it possible to reduce a variation in the mobility correction period and therefore, a variation in the current $I_{ds}$ flowing in the organic EL element 111 at the time of light emission can be reduced and uniformity of intensity can be improved.

Up to this point, the present invention has been described by using the embodiments and the application example, but the present invention is not limited to the embodiments and the like and may be variously modified.

For example, in the application example, the buffer circuits 1 to 4 according to each of the above-described embodiments are used in the output stage of the write-line driving circuit 124. However, these buffer circuits 1 to 4 may be used in an output stage of the power-source-line driving circuit 125 instead of the output stage of the write-line driving circuit 124, or may be used in the output stage of the power-source-line driving circuit 125 together with the output stage of the write-line driving circuit 124.

Further, in the above-described embodiments and the like, the gate voltage of the transistor $Tr_{22}$ before the threshold correction operation is acceptable as long as it is lower than $V_{dd}+V_{th1}$, and the gate voltage of the transistor $Tr_{21}$ before the threshold correction operation is acceptable as long as it is higher than $V_{ss}+V_{th2}$. Therefore, when setting the gate voltage of the transistor $Tr_{22}$ before the threshold correction operation, a voltage line other than the high voltage line $L_{H2}$ may be used. Also, when setting the gate voltage of the transistor $Tr_{21}$ before the threshold correction operation, a voltage line other than the low voltage line $L_L$ may be used.

Still furthermore, the gate voltages of the transistors $Tr_{21}$ and $Tr_{22}$ are held by the capacitors $C_{21}$ and $C_{31}$ and thus, the threshold correction operation of the buffer circuits 1 to 4 may be performed once for each field or once for every a few fields. When the threshold correction operation of the buffer circuits 1 to 4 is performed once for every a few fields, the number of threshold correction operations can be reduced and low power consumption can be achieved.

Moreover, in the above-described embodiments and the like, the threshold correction operation is performed until the gate voltages of the transistors $Tr_{21}$ and $Tr_{22}$ are stabilized. However, the threshold correction operation may be stopped before the gate voltages of the transistors $Tr_{21}$ and $Tr_{22}$ are stabilized. For example, during the threshold correction operation of the transistor $Tr_{21}$, the higher the mobility μ of the transistor $Tr_{21}$ is, the higher the falling speed of the gate voltage of the transistor $Tr_{21}$ is. Therefore, at a certain point in time during the threshold correction operation, the higher the mobility μ of the transistor $Tr_{21}$ is, the lower the gate voltage of the transistor $Tr_{21}$ is, and the lower the mobility μ of the transistor $Tr_{21}$ is, the higher the gate voltage of the transistor $Tr_{21}$ is. When the threshold correction operation is stopped at this point in time, the higher the mobility μ of the transistor $Tr_{21}$ is, the narrower the gate-source voltage $V_{gs}$ of the transistor $Tr_{21}$ is, and the lower the mobility μ of the transistor $Tr_{21}$ is, the wider the gate-source voltage $V_{gs}$ of the transistor $Tr_{21}$ is. In other words, by stopping the threshold correction operation in midstream, the mobility μ of the transistor $Tr_{21}$ can be corrected. This also applies to the transistor $Tr_{22}$. Therefore, the mobility μ of each of the transistors $Tr_{21}$ and $Tr_{22}$ may be corrected by stopping the threshold correction operation in midstream.

The present application contains subject matter related to that disclosed in Japanese Priority Patent Application JP 2009-295552 filed in the Japan Patent Office on Dec. 25, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A drive circuit comprising:

an input-side inverter circuit and an output-side inverter circuit connected to each other in series and inserted between a high voltage line and a low voltage line, wherein the output-side inverter circuit includes a CMOS transistor having a first gate and a second gate, in which a drain is connected to the high voltage line side and a source is connected to an output side of the output-side inverter circuit, a MOS transistor in which a drain is connected to the low voltage line side and a source is connected to the output side of the output-side inverter circuit, and a correction circuit to correct a voltage of one or both of the first gate and the second gate of the CMOS transistor;

wherein the correction circuit sets, in one or both of the first gate and second gate of the CMOS transistor, a voltage corresponding to a threshold voltage of the CMOS transistor as an offset;

wherein the correction circuit includes:

a first transistor in which a first of a source or a drain of the first transistor is connected to a first gate side of the CMOS transistor and a second of the source and the drain of the first transistor is connected to the high voltage line side;

a second transistor in which a first of a source or a drain of the second transistor is connected to the first gate side of the CMOS transistor and a second of the source and the drain of the second transistor is connected to the drain side of the CMOS transistor;

a third transistor in which a first of a source or a drain of the third transistor is connected to the drain side of the CMOS transistor and a second of the source and the drain of the third transistor is connected to the low voltage line side; and a first capacitor in which a first end is connected to the first gate side of the CMOS transistor and a second end is connected to an input side of the input-side inverter circuit, and the correction circuit sets, in the first gate of the CMOS transistor, a voltage corresponding to the threshold voltage of the CMOS transistor as an offset.

2. A drive circuit comprising:

an input-side inverter circuit and an output-side inverter circuit connected to each other in series and inserted between a high voltage line and a low voltage line, wherein the output-side inverter circuit includes a CMOS transistor having a first gate and a second gate, in which a drain is connected to the high voltage line side and a source is connected to an output side of the output-side inverter circuit, a MOS transistor in which a drain is connected to the low voltage line side and a source is connected to the output side of the output-side inverter circuit, and a correction circuit to correct a voltage of one or both of the first gate and the second gate of the CMOS transistor;

wherein the correction circuit sets, in one or both of the first gate and second gate of the CMOS transistor, a voltage corresponding to a threshold voltage of the CMOS transistor as an offset; and wherein the correction circuit includes:

a fourth transistor in which a first of a source or a drain of the fourth transistor is connected to the second gate side of the CMOS transistor and a second of the source and the drain of the fourth transistor is connected to the low voltage line side;

a fifth transistor in which a first of a source or a drain of the fifth transistor is connected to the second gate side of the CMOS transistor and a second of the source and the drain of the fifth transistor is connected to the source side of the CMOS transistor;

a sixth transistor in which a first of a source or a drain of the sixth transistor is connected to the source side of the CMOS transistor and a second of the source and the drain of the sixth transistor is connected to the output side of the output-side inverter circuit; and a second capacitor in which a first end is connected to the second gate side of the CMOS transistor and a second end is connected to an output side of the input-side inverter circuit.

3. A drive circuit comprising:

an input-side inverter circuit and an output-side inverter circuit connected to each other in series and inserted between a high voltage line and a low voltage line, wherein the output-side inverter circuit includes a CMOS transistor having a first gate and a second gate, in which a drain is connected to the high voltage line side and a source is connected to an output side of the output-side inverter circuit, a MOS transistor in which a drain is connected to the low voltage line side and a source is connected to the output side of the output-side inverter circuit, and a correction circuit to correct a voltage of one or both of the first gate and the second gate of the CMOS transistor;

wherein the correction circuit sets, in one or both of the first gate and second gate of the CMOS transistor, a voltage corresponding to a threshold voltage of the CMOS transistor as an offset; and wherein the correction circuit includes:

a fifth transistor in which a first of a source or a drain of the fifth transistor is connected to the second gate side of the CMOS transistor and a second of the source and the drain of the fifth transistor is connected to the source side of the CMOS transistor;

a sixth transistor in which a first of a source or a drain of the sixth transistor is connected to the source side of the CMOS transistor and a second of the source and the drain of the sixth transistor is connected to the output side of the output-side inverter circuit; and a second capacitor in which a first end is connected to the second gate side of the CMOS transistor and a second end is connected to the output side of the input-side inverter circuit.

4. A display device comprising:

a plurality of pixel circuits arranged in a matrix form; and a plurality of the driving circuits according to claim 1, wherein each of the pixel circuits includes:

a capacitor;

a switch TFT configured to receive a voltage signal for the capacitor;

a drive TFT responsive to the capacitors; and a light emitting element responsive to the drive transistor, and wherein each of the driving circuit is coupled to a corresponding row of the pixel circuits.

5. The display device according to claim 4, wherein the light emitting element includes an organic EL element.

6. The display device according to claim 4, wherein an output node of the output-side inverter in each of the driving circuits is connected to a scanning line which is connected to the switch TFT in each of the pixel circuits in the corresponding row.

7. The display device according to claim 4, wherein each of the pixel circuits are configured to execute a correction operation for correcting a dependence of a driving current for the light emitting element on a characteristic of the drive TFT.

8. The display device according to claim 7, wherein an output pulse of one of the driving circuits defines duration of the correction operation of a corresponding one of pixel circuits.

9. A display device comprising:

a plurality of pixel circuits arranged in a matrix form; and a plurality of the driving circuits according to claim 2, wherein each of the pixel circuits includes:

a capacitor;

a switch TFT configured to receive a voltage signal for the capacitor;

a drive TFT responsive to the capacitors; and a light emitting element responsive to the drive transistor, and wherein each of the driving circuit is coupled to a corresponding row of the pixel circuits.

10. The display device according to claim 9, wherein the light emitting element includes an organic EL element.

11. The display device according to claim 9, wherein an output node of the output-side inverter in each of the driving circuits is connected to a scanning line which is connected to the switch TFT in each of the pixel circuits in the corresponding row.

12. The display device according to claim 9, wherein each of the pixel circuits are configured to execute a correction operation for correcting a dependence of a driving current for the light emitting element on a characteristic of the drive TFT.

13. The display device according to claim 12, wherein an output pulse of one of the driving circuits defines duration of the correction operation of a corresponding one of pixel circuits.

14. A display device comprising:

a plurality of pixel circuits arranged in a matrix form; and a plurality of the driving circuits according to claim 3, wherein each of the pixel circuits includes:

a capacitor;

a switch TFT configured to receive a voltage signal for the capacitor;

a drive TFT responsive to the capacitors; and a light emitting element responsive to the drive transistor, and wherein each of the driving circuit is coupled to a corresponding row of the pixel circuits.

15. The display device according to claim 14, wherein the light emitting element includes an organic EL element.

16. The display device according to claim 14, wherein an output node of the output-side inverter in each of the driving circuits is connected to a scanning line which is connected to the switch TFT in each of the pixel circuits in the corresponding row.

17. The display device according to claim 14, wherein each of the pixel circuits are configured to execute a correction operation for correcting a dependence of a driving current for the light emitting element on a characteristic of the drive TFT.

18. The display device according to claim 17, wherein an output pulse of one of the driving circuits defines duration of the correction operation of a corresponding one of pixel circuits.

* * * * *